US008500125B2

(12) United States Patent
Nagayama et al.

(10) Patent No.: US 8,500,125 B2
(45) Date of Patent: Aug. 6, 2013

(54) MEDAL GAME APPARATUS

(75) Inventors: Munetoshi Nagayama, Tokyo (JP); Toshinari Hara, Tokyo (JP); Nobuyuki Iwasaki, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 675 days.

(21) Appl. No.: 12/296,007

(22) PCT Filed: Apr. 3, 2007

(86) PCT No.: PCT/JP2007/057456

§ 371 (c)(1),
(2), (4) Date: Sep. 21, 2009

(87) PCT Pub. No.: WO2007/119659

PCT Pub. Date: Oct. 25, 2007

(65) Prior Publication Data

US 2010/0044960 A1 Feb. 25, 2010

(30) Foreign Application Priority Data

Apr. 5, 2006 (JP) ..... 2006-104313
Apr. 5, 2006 (JP) ..... 2006-104359
Sep. 12, 2006 (JP) ..... 2006-247419

(51) Int. Cl.
*A63B 71/00* (2006.01)

(52) U.S. Cl.
USPC ..... 273/138.3

(58) Field of Classification Search
USPC ..... 273/138.3
See application file for complete search history.

(56) References Cited

U.S. PATENT DOCUMENTS 5,713,572 A * 2/1998 Hagiwara ..... 273/138.3
5,924,927 A * 7/1999 Matsuura et al. ..... 463/62
5,951,009 A * 9/1999 Miyamoto et al. ..... 273/121 B
6,109,613 A * 8/2000 Crompton et al. ..... 273/354
6,312,331 B1 * 11/2001 Tamaki ..... 463/20
7,722,043 B2 * 5/2010 Takeuchi et al. ..... 273/129 R
7,934,726 B1 * 5/2011 Johnson et al. ..... 280/33.992
2006/0027973 A1 * 2/2006 Nireki et al. ..... 273/440
2008/0026852 A1 * 1/2008 Kikuchi ..... 463/42

FOREIGN PATENT DOCUMENTS

JP 07-059906 3/1995
JP 11-000430 1/1999
JP 2000-107346 4/2000
JP 3499217 12/2003
JP 2004-065515 3/2004
JP 2004-174127 6/2004
JP 2004-298374 10/2004
JP 2005-040592 2/2005
JP 2005-334333 12/2005

* cited by examiner

*Primary Examiner* — Kurt Fernstrom
*Assistant Examiner* — Dolores Collins
(74) *Attorney, Agent, or Firm* — Finnegan, Henderson, Farabow, Garrett & Dunner, L.L.P.

(57) ABSTRACT

A medal game apparatus with which a player can sequentially insert a plurality of medals easily and quickly is provided.
A medal apparatus 100 according to this invention includes a station 1 having a medal insertion portion 12, a medal feeding mechanism 14, a medal base 31, a base board 35, a medal receiving unit 4, and a medal payout unit 11. The medal insertion portion 12 is provided so that it can be moved. The medal feeding mechanism 14 is connected to the medal insertion portion 12 and extends in a specified direction. The medal insertion portion 12 is provided next to the medal payout unit 11 and includes a medal placement area 19 on which a plurality of medals M can be laid out flat; a medal alignment groove 16 that is connected to the medal placement area 19 and in which the medals M can be aligned in an upright state; and a medal insertion opening 17 provided at the end of the medal alignment groove 16. In this way, a player can insert medals sequentially.

5 Claims, 16 Drawing Sheets

MEDAL GAME APPARATUS

TECHNICAL FIELD

The present invention relates to a medal game apparatus for which medals and coins are used. Also, the present application relates to the following Japanese patent applications. For the designated countries for which incorporation of documents by reference is admitted, the content of the following applications is incorporated into the present application by reference and deemed to be part of the description of the present application:

Japanese Patent Application No. 2006-104313 filed on Apr. 5, 2006; Japanese Patent Application No. 2006-104359 filed on Apr. 5, 2006; and Japanese Patent Application No. 2006-247419 filed on Sep. 12, 2006.

BACKGROUND ART

Of medal game apparatuses configured so that a player (game player) inserts game play medals or coins (hereinafter and also regarding the present invention collectively referred to as "medals") and the medals can then be collected, medal game apparatuses in which a plurality of medals placed on a board base are pushed off the board base by back-and-forth movement of a pushing plate, and the pushed-out medals are made to fall down to a specified collector; thereby paying out the medals, are generally called "pusher game apparatuses" and various kinds of such pusher game apparatuses are known.

For example, Patent Document 1 discloses a pusher game apparatus in which a medal holding area for holding the paid out medals, a medal alignment groove in which plural medals can be aligned in an upright state, and an operation table like a console panel are integrally formed, and a medal insertion opening connected to the medal alignment groove is made.

With this pusher game apparatus, the player takes a plurality of medals from the medal holding area, aligns them in an upright state in the medal alignment groove, and slides the medals toward the medal insertion opening, thereby inserting the medals sequentially into the medal insertion opening. As a result, a large amount of medals can be continuously inserted into the medal insertion opening easily and quickly, so that workload for inserting medals is reduced.

Patent Document 1: Japanese Patent Laid-Open (Kokai) Application Publication No. 2005-40592

DISCLOSURE OF THE INVENTION

Problems to Be Solved by the Invention

However, the above-described conventional pusher game apparatus requires the player to move the medals, which have been paid out to the medal holding area, to the medal alignment groove. Because of this requiring of the player's action to move the medals, it cannot be said that the workload for inserting medals has been significantly improved.

There is also a type of pusher game apparatus in which a medal insertion portion having a medal insertion opening, and a medal feeding mechanism are formed so that they can be integrally and freely moved. This apparatus has an advantage in its capability to eject medals to a desired position in a pusher game unit when the player themself operates the medal insertion portion.

If plural medals can be continuously inserted into the medal insertion portion easily and quickly also with the above-described pusher game apparatus having the movable medal insertion portion, the operability of the apparatus will be improved and the player can focus on playing the game. Therefore, a possible way to have this happen is to use the conventional medal alignment groove described above in the medal insertion portion. In this case, however, since the medal insertion portion is movable, it is easily conceivable that the action to move the plurality of medals from the medal holding area to the medal insertion portion would be difficult.

The present invention was devised in light of the circumstances described above, and it is an object of the invention to provide a medal game apparatus configured so that a medal insertion opening or a medal feeding mechanism can be moved, and with which a plurality of medals can be sequentially inserted into the medal insertion opening easily and quickly.

Means for Solving the Invention

In order to solve the above-described problem, according to an aspect of the present invention, provided is a medal game apparatus including: a medal insertion portion that can be moved and into which at least one medal can be inserted; a medal feeding mechanism that extends in a specified direction and is connected to the medal insertion portion so that the at least one medal inserted into the medal insertion portion can be delivered to the medal feeding mechanism; a substantially plate-shape medal base that has a specified thickness and is provided below the lower end of the medal feeding mechanism so that the medal base can move back and forth; an interference unit located at one end of the medal base relative to the back-and-forth movement direction and provided so that it interferes with any medals held on the medal base; a base board that protrudes below the medal base and on the other end of the medal base relative to the back-and-forth movement direction, and on which the medals falling from the medal base are held; a medal receiving unit provided below the base board to collect the medals falling from the base board; and a medal payout unit for paying out the collected medals; wherein the medal insertion portion includes: a medal placement area that is located next to the medal payout unit, and on which the medals can be laid out flat; a medal alignment groove that is connected to the medal placement area and in which the medals can be aligned in upright state; and a medal insertion opening formed at the end of the medal alignment groove.

A medal game apparatus according to another aspect of the invention includes: a medal insertion portion that can be moved and into which at least one medal can be inserted; a game execution unit for executing a game, using the medals inserted into the medal insertion portion; and a medal payout unit for paying out the medals in accordance with the results of the game executed by the game execution unit; wherein the medal insertion portion includes: a medal placement area that is located next to the medal payout unit, and on which the medals can be laid out flat; a medal alignment groove that is connected to the medal placement area and in which the medals can be aligned in upright state; and a medal insertion opening formed at the end of the medal alignment groove.

With the medal game apparatus configured as described above, the player can quickly and easily move the medals to the medal insertion portion located next to the medal payout unit by scooping up the medals held in the medal payout unit with his hand(s). Moreover, the player can align the medals in an upright state in the medal alignment groove and continuously insert them into the medal insertion opening by using the medal alignment groove formed in the medal insertion portion.

In this case, it is favorable to have the medal feeding mechanism include: a rail extending in a specified direction to supply the medals to the medal base; and a guide connected to the medal insertion opening to feed the medals inserted into the medal insertion opening to the rail. Furthermore, the medal game apparatus preferably includes a support shaft for pivotally supporting the medal insertion portion so that the medal insertion portion can be freely rotated.

The medal game apparatus also preferably includes a stopper for limiting a movable area of the medal insertion portion to a specified area. Moreover, the medal insertion portion is preferably tapered so that its end periphery closer to the medal payout unit is thinner than the inside part of the medal insertion portion, and the thickness of the medal insertion portion increases toward the inside part of the medal insertion portion. Furthermore, the medal game apparatus preferably includes a curved portion protruding from the front periphery of the medal payout unit to cover at least part of the end periphery of the medal insertion portion.

Advantageous Effect of the Invention

The operability of a medal game apparatus can be enhanced by providing a medal game apparatus whose medal insertion opening or medal feeding mechanism can be moved, and with which a plurality of medals can be sequentially inserted into the medal insertion opening easily and quickly.

BEST MODE FOR IMPLEMENTING THE INVENTION

Embodiments of the present invention will be described below in detail. Incidentally, elements keep the same reference numerals and any redundant explanation is omitted. Unless specifically defined, the positions such as upper side, lower side, right, and left are based on the positional relationships illustrated in the attached drawings. Also, the dimension ratios of the drawings are not limited to the ratios employed in the drawings. The embodiments described below are for the purpose of describing this invention, but the invention is not limited only to these embodiments. Accordingly, this invention can be utilized in various ways unless the utilizations depart from the gist of the invention.

FIG. 1 is a perspective external view of a pusher game apparatus as an example of the medal game apparatus according to the invention. A pusher game apparatus 100 is not only configured to enable a player to insert medals and then collect them by means of a pusher function, but can also run various games and pay out more medals. The pusher game apparatus 100 is configured so that a plurality of stations 1 are provided on housing K composed of a base housing Ka, a console housing Kb, and an upper housing Kc.

In this embodiment, two stations 1, 1 are placed side by side on the right and left side parts of the housing K, and a console panel 10 shared by the two stations 1, 1 protrudes from the respective stations 1, 1. The console housing Kb and the upper housing Kc are made of a translucent material so that their inside region can be seen.

Each station 1 has a medal payout unit 11, a medal insertion portion 12, and a ball shooting button 13 provided on the console panel 10; a V-zone game unit 2 located behind the console panel 10; and a pusher game unit 3 (game execution unit) provided below the V-zone game unit 2. A medal feeding mechanism 14 that can be moved while holding medals M and is set below the medal insertion portion 12 so that the medal feeding mechanism 14 is inclined downwards toward its end, is connected to the medal insertion portion 12. Incidentally, it is favorable to have two sets of the medal insertion portion 12 and the medal feeding mechanism 14 for each station 1, but one of the two sets is omitted in FIG. 1 (and also omitted in FIGS. 3 and 7).

The V-zone game unit 2 is configured so that a gimmick disk 22 (rotary board) is placed on a slope 21 inclined with its upper part (relative to the console panel 10) leaning closer to the back of the pusher game apparatus 100, so that the gimmick disk 22 can rotate on the slope 21. A medal ejection unit 21*b* with an opening from which medals M are ejected is placed at the upper part of the slope 21. The V-zone game unit 2 has a display 23 located on its upper front surface, and a V-checker 24 (first medal-passing area), which is located below the gimmick disk 22 and through which the medals can pass. This V-checker 24 is defined by a pair of plate members 24*a* placed opposite each other with a space between them and the space has a width Dp larger than the outside diameter $D_M$ of a medal M so that the medal M can pass through.

A plurality of grooves 22*a*, each of which is slightly wider than the outside diameter $D_M$ of a medal M, are made in a peripheral area of the gimmick disk 22. A medal guide 22*b* composed of a pair of protruding members (protrusions) spaced apart from each other is provided in the top-surface center area of the gimmick disk 22. Also, a shutter 25 (shutter unit) having an arched belt shape is provided around and in the vicinity of the lower part of the gimmick disk 22 so that the shutter 25 can be moved up and down relative to the slope 21.

The display 23 is connected to a video game control unit (not shown in the drawing) for generating images of a video game such as a slot game. When a medal inserted into the medal insertion portion is detected, or when a medal passing through the V-checker 24 is detected, a game image generated by this video game control unit is displayed on the display 23, and various games, such as a roulette game, a shooting game, or an action game, are run.

FIG. 5 is a perspective view of the gimmick disk 22 and the main parts around it. FIG. 6 is a side view of part of the gimmick disk 22 where a groove 22*a* is formed (a front view of the peripheral wall of the gimmick disk 22). In this embodiment, there are six grooves 22*a* located equally spaced apart around the periphery of the gimmick disk 22. Each groove 22*a* is a U-shaped groove that is open at the periphery of the gimmick disk 22, is slightly wider than the outside diameter of a medal M, and sufficiently longer toward the center of the gimmick disk 22 than the outside diameter of a medal M, and the depth Dg of the groove 22*a* is, for example, almost twice the thickness of a medal M. As a result, medals M can be held in the groove 22*a*. When two medals M pile up, the difference in level between the top surface of the piled medals M and the top surface 22*m* of the gimmick disk 22 will be substantially eliminated.

As shown in the drawings, the groove 22*a* is chamfered or tapered around its opening, thereby forming a chamfer 22*t*. This chamfer 22*t* guides medals M so that they can be easily received by (or fit into) the groove 22*a*. If the medal once received in the groove 22*a* is caught by the shutter 25, the chamfer 22*t* makes it easier for the medals M to come out of the groove 22*a* along the chamfer 22*t* as the gimmick disk 22 rotates.

Concerning the pair of protruding members constituting the medal guide 22*b*, each protruding member is of a flat semicircular shape and the protruding members are spaced apart from each other with their respective straight sides facing. The width Dp of the space is slightly larger than the outside diameter of a medal M so that the space is wide enough to let a medal M pass through. Therefore, the space in the medal guide 22*b* extends along the diameter of the gimmick disk 22 for the length of the protruding member.

Moreover, the shutter 25 is provided so that its upper end face 25*m* is almost the same height as that of the top surface 22*m* of the gimmick disk 22 where the shutter 25 has been raised along the peripheral wall 22*h* of the gimmick disk 22.

The V-zone game units 2, 2 are connected to each other via a boundary panel 20 that has a jackpot payout unit 20*a* on its top.

The pusher game unit 3 has a medal base 31 that can temporarily hold the medals M that fall down from the V-zone game unit 2 and move back and forth relative to the console panel 10. A plurality of checkers 32 (second medal passing area) are provided on the front wall 31*a* of the medal base 31. Also, a guide 33 is set along one side wall of the medal base 31.

A guide 34 is set between the medal bases 31, 31 along their side walls and shared by the two pusher game units 3, 3. Furthermore, a flat-plate-like base board 35 is provided under the medal bases 31, 31 and the guides 33, 33, 34 in such a manner that the base board 35 protrudes forward from the medal bases 31, 31 and temporarily holds the medals M falling down from the medal bases 31, 31. The medal bases 31 move and slide on and in contact with the base board 35. Moreover, a medal receiving unit 4 having an opening 4*a* is provided in front of and below the base board 35 and inside the base housing Ka. This medal receiving unit 4 is connected to medal hoppers 41 that are connected to the medal payout units 11.

On the other hand, a carnival game unit 5 is provided above the V-zone game unit 2. The carnival game unit 5 is configured so that a ball striking unit 51 supported by the side top of the V-zone game unit 2 on both ends of a guide rail unit 50, on which ball B is held and can move. Incidentally, a "carnival game" means attractions such as quoits and shooting games, like those often seen at fairs and festivals, and the carnival game unit 5 in this embodiment is designed to play a game by rolling the ball B with the aim of gaining a large amount of paid out medals M.

The guide rail unit 50 is composed of a plurality of rails that extend upward and toward the back of the game apparatus from the ball striking unit 51, bend near the top end of the V-zone game unit 2, and then extend horizontally above the V-zone game units 2, 2. A position sensor D for detecting the position of the ball B is set along the horizontal portion of the rails. The ball striking unit 51 has a plurality of ball stoppers 51*a* provided in a multistep form and a ball striking mechanism 51*b* including an elastic member, and is used to hold the ball B and strike the ball B onto the guide rail unit 50 when certain conditions are met.

Furthermore, a ball collection mechanism 52 for returning a ball B, which has stopped on the rails, to the ball striking unit 51 is provided above the horizontal portion of the guide rail unit 50. The ball collection mechanism 52 is configured so that a jig 52*b* located to interfere with the ball B in a vertical direction is placed on a guide rod 52*a* extending along the horizontal portion of the guide rail unit 50 so that the jig 52*b* can slide on the guide rod 52*a*. Also, return-preventing stoppers 55, 55 capable of moving up and down are set above both ends of the horizontal portion of the guide rail unit 5.

FIG. 2 is a schematic block diagram showing the functional configuration of the pusher game apparatus 100. Each station 1 has an arithmetic control unit 15, which is connected to the aforementioned V-zone game unit 2, pusher game unit 3, and medal receiving unit 4, as well as a sound output unit 8 for outputting various sounds.

Furthermore, the arithmetic control unit 15 for each station 1 is connected via bus Bu for inputting/outputting data or communication signals to an arithmetic control unit 65 for a common processing unit 6 (host) having a host function for the stations 1. This arithmetic control unit 65 is connected to: the aforementioned carnival game unit 5; a memory unit 61 on which OS programs, programs for running various games, and data are stored so that it can be read or written permanently or temporarily; a lighting unit 62 composed of various lighting equipment used for the pusher game apparatus 100; and the sound output unit 8. Furthermore, each station 1 and the common processing unit 6 are connected to a power supply system (not shown in the drawing). Incidentally, the arithmetic control unit 65 for the common processing unit 6 can be connected to a common processing unit 6 (or its arithmetic control unit 65) for another pusher game apparatus 100 to enable communication between the pusher game apparatuses 100.

The procedure for executing an example of a medal game with the pusher game apparatus 100 configured as described above will be explained below. FIG. 3 is a perspective view of the main parts of the pusher game apparatus 100 and mainly shows part of the V-zone game unit 2 and the pusher game unit 3. FIG. 4 is a flowchart illustrating an example of the procedure for executing a medal game with the pusher game apparatus 100.

Pusher Game: Step S1

When a player inserts a medal M into the medal insertion portion 12, the medal M is ejected by the medal feeding mechanism 14 onto the medal base 31. The medal base 31 moves back and forth (in the directions indicated with arrow X in FIG. 3). As medals M are accumulated on the medal base 31, the medals on the medal base 31 come to interfere with the lower-end front wall 27 (interference unit) of the V-zone game unit 2, and the medals M are then pushed toward the front part of the medal base 31 and fall down to the base board 35 (see arrow Y1 in FIG. 3). The fallen medals M are pushed forward by the lower end of the front wall 31*a* of the medal base 31.

In this way, the medals M are gradually accumulated on the base board 35; and the medals M which have been pushed by the medal base 31 and have thereby overflowed from the base board 35 fall down through the opening 4*a* and are then received by the medal receiving unit 4. The medal receiving unit 4 detects that the medals M have been collected; and a detection signal is input to the arithmetic control unit 15, which then commands the medal hopper 41 to pay out the medals M. As a result, the medals M which have fallen from the base board 35 to the medal receiving unit 4 or an equivalent amount of other medals M are ejected by the medal hopper 41 for the medal receiving unit 4 to the medal payout unit 11 and supplied to the player. Incidentally, the medals M may be paid out by the medal receiving unit 4 performing the action to pay out the medals to the medal payout unit 11 after a certain amount of time has elapsed since the medal insertion portion 12 detected the insertion of the medals M into the medal insertion portion 12

When the inserted medals M fall down from the medal base 31 to the base board 35 in the normal pusher game described above, if a medal passes through any of the checkers 32 (checker hit), various games different from the normal game will be executed.

Chucker Hit and Medal Payout: Step S2

If a medal M pass through any of the checkers 32 (for example, as indicated with arrow Y3 in FIG. 3), a detection signal from a pass sensor (not shown in the drawing) provided in the checker 32 is input to the arithmetic control unit 15, which then commands the V-zone game unit 2 to pay out medals M. As a result, the amount of medals M previously assigned to the relevant checker 32 through which the medal M has passed is paid out from above the slope 21 of the V-zone game unit 2 toward the medal base 31. In this way, the pass sensors provided in the checkers 32 and the arithmetic control unit 15 constitute the second control unit.

In the example shown in FIG. 3, two medals M will be paid out when a medal M passes through the checker 32 numbered "2"; and one medal will be paid out when a medal M passes through the checker 32 numbered "1." Incidentally, the relevant checker(s) 32 and the medal M payout amount are stored as, for example, a data table in the memory unit for the common processing unit 6. The arithmetic control unit 65 refers to this data table, and further communicates the information in the data table to the arithmetic control unit 15 for the station 1 (the same applies to similar processing described later).

The paid-out medals M are scattered in various directions due to rotation of the gimmick disk 22 and contact with a plurality of grooves 22*a* (difference in level) in the gimmick disk 22 and fall over the slope 21 and the gimmick disk 22 (for example, as indicated with arrow Y4 in FIG. 3), and are then ejected through a payout opening 26 for the V-zone game unit 2 toward the medal base 31.

Slot Game: Step S3

In the case of the checker hit, a slot game is also performed in addition to the payout of the specified amount of medals M. Specifically speaking, a detection signal from the pass sensor for the checker 32 is input to the arithmetic control unit 15, which then commands commencement of a slot game based on the detection signal; and a slot game image is displayed on the display 23 and the displayed slot starts rolling. The slot starting rotation number in this example is set to the same as the payout amount of medals M. If the same slot images appear in a row, a chance time game will be run or the step-point bonus processing described below will be executed. Not only the images are displayed on the display 23, but also slot game sounds are output from the sound output unit 8.

Chance Time Game: Step S4

If the images previously specified for a chance game, from among plural kinds of images displayed on the display 23, appear in a row in the slot game, that information is input to the arithmetic control unit 15 and the processing proceeds to a chance time game with a time limit.

The chance time game of this embodiment guarantees a medal M payout rate of 100% or more, and is performed using the V-checker 24, the checkers 32, and a menu and game images displayed on the display 23. In this example, three types of chance time game are prepared as described below.

Once the chance time game is started, the player can collect no less than the inserted amount of medals without fail by inserting as many medals as possible into the medal insertion portion 12. If the player succeeds in successfully completing the chance time game (corresponding to the "big payout" described later), he gains one step-point (described later in detail).

If the opportunity for the chance time game is given to one of the stations 1 in this embodiment, the other station 1 will also be given a chance time game.

4-Point Chance

The purpose of this chance time game is to make the medals M pass through all the checkers within a specified time limit. The "4-point" means one V-checker 24 and three checkers 32 in the drawings. If the player succeeds in making the medals M pass through all these checkers, he will get a "perfect prize" and an amount of medals M considerably larger than the amount of medals M inserted during the chance time game will be paid out ("big payout" or "jackpot").

Even if the player fails to make the medals M pass through all the checkers, if he succeeds in making the medals M pass through at least one checker, a fair amount of medals M will be paid out ("small payout" or "small hit"). Incidentally, the display 23 graphically displays the time limit as well as the checker(s) through which the medals M have passed, and the checker(s) through which the medals M have not passed, so that the player can easily recognize the game status.

Bingo Chance

The purpose of this chance time game is to make medals M pass through the checkers and thereby get bingo cards in a row within a specified time limit. It is similar to a common bingo game in which a player uses a numerical table with one or two-digit natural numbers located randomly in, for example, a 5×5 matrix, and the player wins the game when a complete vertical, horizontal, or diagonal row of numbers in the table is marked. For example, five numbers are checked if a medal M passes through the V-checker 24; one number is checked if a medal M passes through the checker 32 numbered "1"; and two numbers are checked if a medal M passes through the checker 32 numbered "2."

If the player succeeds in obtaining more than one complete line of numbers, an amount of medals M considerably larger than the amount of medals M inserted during the chance time game will be paid out ("big payout" or "jackpot"). Even if the player succeeds in obtaining only one complete line of numbers, a fair amount of medals M will be paid out ("small payout" or "small hit"). Incidentally, the display 23 displays the time limit as well as the bingo card images and numbered ball images at the same time, and the display 23 graphically displays the determined numbers and the numbers on the bingo cards corresponding to the determined numbers in order to differentiate them from other numbers and other parts of the images. Therefore, the player can easily recognize the game status.

Payback Chance

The purpose of this chance time game is to make medals M pass through the checkers and thereby extend the originally determined time limit for the chance time game. The time is extended depending on which checker a medal M has passed through. For example, if a medal M passes through the V-checker 24, the time limit will be extended for five seconds; if a medal M passes through the checker 32 numbered "1," the time limit will be extended for two seconds; and if a medal M passes through the checker 32 numbered "2," the time limit will be extended for three seconds. These time periods are added to the time limit for the game.

If the player succeeds in continuing playing the game beyond the separately specified time for timeout because of the extension of the time limit by a medal passing through a checker, this situation is a "special bonus time" and an amount of medals M considerably larger than the amount of medals M inserted during the chance time game will be paid out ("big payout" or "jackpot"). Even if the player fails to reach the special bonus time, if he succeeds in making a medal M pass through at least one checker, a fair amount of medals M will be paid out ("small payout" or "small hit"). Incidentally, like the 4-point chance, the display 23 graphically displays the time limit as well as the checker(s) through which the medals M have passed, and the checker(s) through which the medals M have not passed, so that the player can easily understand the game state-of-play.

Step-Point Bonus Processing: Step S5

If the images predetermined for step-point bonus, from among plural kinds of images displayed on the display 23, appear in a row in a slot game, this situation is "step-point bonus" and that information is input to the arithmetic control unit 15, one step-point is gained, and one step from among the plural ball stoppers 51*a* for the ball striking unit 51 which holds the ball B as described above flattens.

The same applies to the case where the step-point(s) is (are) gained by successfully completing the aforementioned chance time game(s). In the initial state of the ball striking unit 51, all the ball stoppers 51*a* are placed upright to block the ball B. If one step-point is gained, the farthest ball stopper 51*a* from the ball striking mechanism 51*b* flattens and the ball B moves one step down to the next ball stopper 51*a* toward the front side of the game apparatus 100. If the specified number of step-points (normally corresponding to the number of the ball stoppers 51*a*) is gained, the player can play a jackpot carnival game next.

Jackpot Carnival Game: Step S6

This jackpot carnival game is intended to aim at the payout of a large amount of medals M that is set based on the position where the ball B, which has been shot, stops on the guide rail unit 50 in the carnival game unit 5.

If the specified number of step-points is gained, all the ball stoppers 51*a* flatten and the ball B reaches the ball striking mechanism 51*b*. As a result, the ball B can be struck out toward the guide rail unit 50 under the control of the arithmetic control unit 65 for the common processing unit 6. The ball B striking strength is displayed on the display 23 as a measure like an extendable gauge. When the gauge reaches a desired length, the player can adjust the ball B striking strength by pushing down a ball shooting button 13 on the console panel 10.

Once the ball shooting button 13 is pushed down, the ball striking mechanism 51*b* for the ball striking unit 51 strikes the ball B with the strength decided by the player. When this happens, the return preventing stoppers 55 are raised so that they will not interfere with the ball B. The ball B on the rails moves on the guide rail unit 50 and stops at a certain position on the horizontal portion of the guide rail unit 50. The ball B may sometimes move to one end of the horizontal portion of the guide rail unit 50 and move back to the other end more than once before it finally stops. When the ball B reaches the horizontal portion, the return preventing stoppers 55, 55 are lowered so that they will keep interfering with the ball B to prevent it from returning to the ball striking unit 51 side.

When the ball B stops, the position sensor D detects the stop position and the amount of medals M as displayed on a jackpot display 7 is paid out based on the stop position from a jackpot payout unit 20*a* toward the medal base 31 for the station 1 which has executed the game.

Regarding this embodiment, while one station 1 performs the jackpot carnival game, another station 1 can perform the normal game and various games other than the jackpot carnival game. However, even if an opportunity of the jackpot carnival game arises at the other station 1, that station 1 enters a standby mode for the execution of the jackpot carnival game until the on-going jackpot carnival game is finished.

V-Zone Bonus Game: Step S7

If a medal M passes through the checker 32 (checker hit: step S2) as described above, the slot game will be performed (step S3); and based on the result of the slot game, the processing proceeds to subsequent game processing. Meanwhile, when medals M paid out from the medal ejection unit 21*b* opened above the slope 21 of the V-zone game unit 2 toward the medal base 31 as a result of the checker hit fall over the slope 21 and the gimmick disk 22 and any of the medals M passes through the V-checker 24, the V-zone bonus game will be started.

If a medal M falling from the medal base 31 down to the base board 35 passes through the checker 32 during execution of the V-zone bonus game, the amount of medals paid out will increase compared to the amount of medals normally paid out when a medal passes through the checker 32 (for example, twice as many as normal). Specifically speaking, if a medal M passes through the checker 32 numbered "2," two medals M will be normally paid out; however, during the execution of the V-zone bonus game, for example, four medals M will be paid out to the V-zone game unit 2. Therefore, the V-zone bonus game guarantees a medal payout rate of 100% or more.

The V-zone bonus game terminates when no more medals M pass through the V-checker 24 after a specified time period (for example, one minute) has elapsed or after a specified amount of medals M (for example, ten medals) have been paid out. However, if a medal(s) M passes through the V-checker 24 on the above-specified conditions, the V-zone bonus game will be continuously executed.

More specifically, when a medal M passes through the V-checker 24, a detection signal from the pass sensor (not shown in the drawing) provided in the V-checker 24 is input to the arithmetic control unit 15 and then this V-zone bonus game is started based on a command from the arithmetic control unit 15. When this happens, the shutter 25 which, in its normal state, is lowered from the V-checker 24 top surface level down to the slope 21 level, moves up and stops so that the upper end face 25*m* of the shutter 25 reaches almost the same level as the top surface 22*m* of the gimmick disk 22 (see FIG. 6); and the shutter 25 then remains at that position. Accordingly, the pass sensor provided in the V-checker 24 and the arithmetic control unit 15 constitute the first control unit.

If the shutter 25 enters the above-described state, the flow of the medals M falling down the slope 21 is blocked by the shutter 25 and the medals M will be accumulated in the grooves 22*a* in the gimmick disk 22. When each groove 22*a* in the gimmick disk 22 is filled with the medals M and the level difference between the shutter 25 and the accumulated medals M is eliminated, the movement of the medals M falling down the slope 21 will be barely affected by the grooves 22*a*; and even if the gimmick disk 22 continues to rotate in a direction, for example, that indicated with arrow Y5 in FIG. 5, the medals M will easily slip directly downward as indicated with arrow Y6 in FIG. 5. This makes it even easier for the medals M to fall into the V-checker 24. In other words, the medal winning rate of the V-checker 24 increases and, therefore, the possibility of continuous execution of the V-zone bonus game increases. As a result, the amount of medals M ejected to the V-zone game unit 2 increases cumulatively, and the number of medals M passing through the checkers 32, i.e., the number of checker hits, increases dramatically.

If the medals M fall down in the direction indicated with arrow Y6 in FIG. 5, since the movement of the medals M is limited by the space in the medal guide 22*b*, the movement range of the medals M is further narrowed, i.e., the medal guide 22*b* defines a flow path for the medals M like one indicated with arrow Y6 in FIG. 5. As a result, the medals M can fall into the V-checker 24 more easily.

If the player wins a checker hit during the V-zone bonus game, the aforementioned slot game (step S3) will not be executed and the medals M are reserved for the chance time game (step S4) which may be executed immediately after the slot game. If the amount of reserved medals is increased by the V-zone bonus game, it is possible to increase the amount of medals M to be paid out for the chance time game after the slot game when the player wins a checker hit during the normal game. If the V-zone bonus game terminates, the shutter 25 returns to the normal state where it is lowered from the V-checker 24 top surface level down to the slope 21 level.

If a medal M passes through the checker 32 during the pusher game with the pusher game apparatus 100 configured as described above, medals M are ejected from the medal ejection unit 21*b* for the V-zone game unit 2 to the gimmick disk 22; and if a medal M falling down the gimmick disk 22 passes through the V-checker 24, the V-zone bonus game will be started. When the V-zone bonus game starts, the shutter 25 is raised, the medals falling over the gimmick disk 22 are blocked by the shutter 25, and the grooves 22*a* are filled with the medals M so that the level difference between the grooves 22*a* and the top surface 22*m* of the gimmick disk 22 will be eliminated. As a result, the medals M can easily fall directly downward over the gimmick disk 22, thereby making it easier for the medals M to pass through the V-checker 24. Therefore, the V-zone bonus game will be executed continuously. If the medal(s) further pass through the checker(s) 32, the amount of medals M to be ejected will increase and the rate of the medals M passing through the V-checker 24 will further increase. As a result, a player can obtain more medals M than was expected.

Since the shutter 25 is raised in the above-described situation to reach almost the same height as that of the top surface 22*m* of the gimmick disk 22, the openings of the relevant grooves 22*a* in the gimmick disk 22 are appropriately (sufficiently) covered with the shutter 25, so that the medals M fall smoothly from above the gimmick disk 22 down to the V-checker 24 while the grooves 22*a* are filled with the medals M and the shutter 25 does not block the flow of the medals M more than necessary. As a result, the medals M falling down the gimmick disk 22 are guided directly downward without fail, thereby further increasing the rate of medals M falling into the V-checker 24.

Also, the chamfer 22*t* is formed in each groove 22*a* in the gimmick disk 22 so that medals M can be easily guided into and received by the groove 22*a*. Therefore, when the medals M are blocked by the shutter 25, it is possible to avoid any inconvenient situation where a medal M fails to enter the groove 22*a* smoothly and is caught by the shutter 25, so that the medal blocks the flow of other medals M. If a medal M which has entered the groove 22*a* once is caught by the shutter 25, as the gimmick disk 22 rotates, it becomes easier for that medal M to slip out of the groove 22*a* along the chamfer 22*t*. Therefore, it is possible to prevent damage to mechanisms such as the shutter 25 and the gimmick disk 22.

Furthermore, since the depth Dg of the groove 22*a* is substantially twice as large as the thickness of a medal M, when two medals M are piled in the groove 22*a*, the level difference between the top surface of the two medals M and the top surface 22*m* of the gimmick disk 22 around the medals becomes sufficiently small, i.e., the level difference is sufficiently eliminated. As a result, the medals M piled in the groove 22*a* are prevented from sticking out of the groove 22*a* and blocking the flow of medals M. Therefore, the medals M falling down the gimmick disk 22 are guided directly downward without fail, thereby further increasing the rate of medals M falling into the V-checker 24.

Furthermore, since the medal guide 22*b* which is composed of a pair of protruding members spaced apart from each other with the space being larger than the outside diameter of a medal M and extend in a diameter direction of the gimmick disk 22 is provided in the approximately central area of the top surface 22*m* of the gimmick disk 22, the movement range of medals M falling over the gimmick disk 22 directly downward is limited, and the space of width Dp in the medal guide 22*b* becomes the flow path for the medals M, and it becomes more easier for the medals M to pass through the flow path and fall into the narrow range. As a result, the medals M falling down the gimmick disk 22 are more easily guided directly downward, thereby further increasing the rate of medals M falling into the V-checker 24.

Next, a medal insertion device including the medal insertion portion 12 and the medal feeding mechanism 14 will be explained.

FIG. 7 is a perspective view of the main parts of a medal insertion device utilized in the pusher game apparatus 100. FIG. 8 is a plan view of the main parts of the medal insertion device. FIG. 9 is a cross-sectional view of the main parts of the medal insertion device as taken along line VII-VII in FIG. 8. FIG. 10 is a cross-sectional view of the main parts of the medal insertion device as taken along line VIII-VIII in FIG. 8. FIG. 11 is a cross-sectional view of the main parts of the medal insertion device as taken along line IX-IX in FIG. 8. FIG. 12 is a cross-sectional view of the main parts of the medal insertion device as taken along line X-X in FIG. 8.

The medal insertion portion 12 is provided on the right or left front side of the pusher game apparatus 100 (closer to the player) near the medal payout unit 11 and as a separate element independently from the console panel 10, so that the medal insertion portion 12 can slide on the console panel 10 (see, for example, arrow Z1 in FIG. 8).

Each medal insertion portion 12 has a medal alignment groove 16, a medal insertion opening 17, and a medal placement area 19. The medal alignment groove 16 is formed in the top surface of the medal insertion portion 12 and is the area designed to align a plurality of medals M in an upright state. The medal alignment groove 16 is a groove that extends linearly on the medal insertion portion 12 and is open on the top; and the inside wall of the medal alignment groove 16 includes a curved face 80 having a generally semicircular arch cross-sectional shape having a curvature radius larger than that of the periphery of a medal M as shown in FIG. 9. The width W of the medal alignment groove 16 is designed to be larger than the diameter of a medal M. A side wall 81 is formed at one end (relative to its lengthwise direction) 16*a* of the medal alignment groove 16 as shown in FIG. 10. The medal insertion opening 17 is formed at the bottom of the medal alignment groove 16 near the side wall 81. Incidentally, as shown in FIG. 9, it is favorable to form the medal alignment groove 16 so that it gradually slopes from the other end of the medal alignment groove 16 (opposite the end 16*a*) downward toward the end 16*a*. As a result, it becomes easier to guide the medals M into the medal insertion opening 17.

The medal insertion opening 17 is a long rectangular slit (in a planar view) into which medals M can be inserted in an upright state, and which is open from the top to the bottom (of the medal insertion portion 12. When the plurality of medals M aligned in an upright state inside the medal alignment groove 16 are moved until the first medal of the aligned medals M located closest to the medal insertion opening 17 comes into contact with the side wall 81 of the medal alignment groove 16, this medal M will pass and fall down through the medal insertion opening 17.

The medal placement area 19 is an area in the top surface of the medal insertion portion 12 and is designed to allow a plurality of medals M to be laid out flat. This medal placement area 19 is placed next to the medal payout unit 11 and connected to and integrated with the medal alignment groove 16.

Meanwhile, the medal feeding mechanism 14 has a guide 82 and a rail 83. The guide 82 is an element that is connected to the lower part of the medal insertion portion 12, receives medals M inserted into the medal insertion opening 17, and sends them to the rail 83. The medal insertion portion 12 and the medal feeding mechanism 14 are configured so that the guide 82 is located under the medal insertion opening 17 and they are connected to each other. Incidentally, the medal insertion portion 12 and the medal feeding mechanism 14 can be connected to each other by, for example, fastening a bend portion 82*a* at the upper end of the guide 82 to the lower part of the medal insertion portion 12 with screws so that the medals inserted into the medal insertion portion 12 can be delivered to the medal feeding mechanism 14.

The rail 83 is supported pivotally by a support shaft 84 extending generally perpendicularly to the rail 83 so that the rail 83 can freely rotate around the support shaft 84 (see arrow Z2 in FIG. 8); and the rail 83 is set so that it is inclined downward toward its far end (i.e., from the front side toward the back side of the pusher game apparatus 100). The cross-section of the rail 83 is an elongated groove which is open on the top and is of a U-shape or a shape composed of three straight lines with each pair of two adjacent lines forming a 90-degree angle. The rail groove is deep enough to hold medals M in an upright state. In this way, a medal sent from the medal insertion opening 17 via the guide 82 to the rail 83 rolls and moves in an upright state on the rail 83 toward the far end of the rail 83 (see arrow Z4 in FIG. 11) and is then discharged onto the medal base 31.

As described above, the rail 83 is configured so that it can freely rotate around the support shaft 84. However, in order to enhance the entertainment value and game-feel, it is favorable to limit the swing angle of the rail 83 to a specified range. In this embodiment, the console panel 10 has a swing-angle limiting hole 18 as shown in FIGS. 8 and 9. This swing-angle limiting hole 18 is made through the console panel 10, and has an arcuate shape whose arch constitutes part of a circle with the support shaft 84 as the circle center. Meanwhile, a claw 86 is provided at the lower part of the medal insertion portion 12 and this claw 86 is made to pass through the swing-angle limiting hole 18. The claw 86 is shaped to loosely fit in the swing-angle limiting hole 18 and is capable of moving in the arcuate direction. In this way, the claw 86 engages with the swing-angle limiting hole 18 and serves as a stopper to limit the movable range of the medal insertion portion 12. As a result, the swing angle of the rail 83 is limited to a certain range. Incidentally, the swing angle of the rail 83 can be adjusted by changing the position and shape of the swing-angle limiting hole 18. Also, at least one pair of the claw 86 and the swing-angle limiting hole 18 would be enough, but it is favorable to have plural pairs of the claw 86 and the swing-angle limiting hole 18 in terms of stability of the strength and swing angle. Additionally, instead of swinging the medal insertion portion 12 only in the arcuate direction around the central axis of the support shaft 84, the medal insertion portion 12 may be designed to slide back and forth, or from side to side, or back and forth and from side to side without using the support shaft 84 and by making one or more long holes or holes larger than the claw 86 (not shown in the drawings) in the console panel 10 and inserting the claw 86 into the long hole(s) or the hole(s) larger than the claw 86. Incidentally, the support shaft 84 and the claw 86 may be attached to either the rail 83 or the medal insertion portion 12.

Furthermore, it is favorable to have an anti-lift plate 87 at the lower part of the claw 86 and the console panel 10 held between the anti-lift plate 87 and the medal insertion portion 12, thereby preventing the medal insertion portion 12 from lifting up. The anti-lift plate 87 is provided so that the claw 86 will not slip out of the swing-angle limiting hole 18; and, for example, the length of the anti-lift plate 87 in one direction (a radial direction of the circle with the support shaft 84 as its center) is longer than the length of the shorter width of the swing-angle limiting hole 18. Placement of this anti-lift plate 87 ensures that the medal insertion portion 12 can slide on the console panel 10. Therefore, it is possible to suppress excessive stress generated at the rail 83 or the support shaft 84, thereby improving durability of the medal insertion device.

The medal payout unit 11 is an area in which a plurality of medals M paid out from a medal payout opening (omitted in the drawings) are held, and which is recessed and shaped like a box having a rectangular planar view. As shown in FIG. 12, it is favorable to make the front wall 111 of the medal payout unit 11 slope so that the recess becomes shallower toward the font side (the side closer to the player, for example, the left side in FIG. 12) or toward the adjacent medal insertion portion 12.

Part 88 of the periphery of the medal insertion portion 12 that is close to the medal payout unit 11 (hereinafter referred to as the "medal-introducing portion 88") is formed as a slope so that the medal-introducing portion 88 is tapered or becomes thinner toward its the end periphery as shown in FIG. 12, and is also inclined to gradually increase its thickness from the medal payout unit 11 side toward the front side (closer to the player) or toward the inside of the medal insertion portion 12. It is favorable to configure the medal-introducing portion 88 so that when the player introduces medals M from the medal payout unit 11 to the medal insertion portion 12 and then moves them to the medal placement area 19, the medals M will be prevented from being stuck at/on/in the medal-introducing portion 88.

Furthermore, it is favorable to form part 89 of the periphery of the medal insertion portion 12 excluding the medal-introducing portion 88 (hereinafter referred to as the "raised periphery 89") so that the raised periphery 89 is raised compared to the area around the medal alignment groove 16 or the medal placement area 19 as shown in FIG. 12 and other drawings. Accordingly, the raised periphery 89 prevents the medals M placed on the top surface of the medal insertion portion 12 from falling off to the console panel 10.

An example of the medal insertion action to insert medals M into the medal insertion opening 17, using the medal insertion device configured as described above will be explained below with reference to FIG. 7.

The player first scoops the medals M held in the medal payout unit 11 as if stroking the front wall 11 of the medal payout unit 11, moves the medals M as if sliding them from the front wall 111 to the medal-introducing portion 88, and further moves them directly to the medal placement area 19 on the top surface of the medal insertion portion 12 (S90). Since the front wall 111 and the medal-introducing portion 88 are formed as if they constitute a continuous gentle slope from the front wall 111 to the medal-introducing portion 88, hardly any problem, for example, medals M getting stuck between them happens when the player moves the medals M to the medal placement area 19.

Next, the player moves the medals M, which have been laid out flat on the medal placement area 19, to the medal alignment groove 16 connected to the medal placement area 19 (S91). When the medals M are moved to the medal alignment groove 16, the medals M are laid out flat, but the player puts them in an upright state and aligns them so that the medals M are stacked together in their thickness direction. Since the medal alignment groove 16 has the curved face 80 which is connected to the medal placement area 19 and is ideal for use in aligning and retaining the plurality of medals M in an upright state, the player can easily align many medals M on the medal insertion portion 12 by moving the medals M as if sliding them from the medal placement area 19 to the medal alignment groove 16.

If the player then pushes and moves the medals M, which have been aligned in an upright state in the medal alignment groove 16, toward the end 16*a*, the medal M closest to the medal insertion portion 17 (see arrow Z3 in FIG. 10) comes into contact with the end 16*a* of the medal alignment groove 16 as shown in FIG. 10. This medal M which has come into contact with the end 16*a* then falls into the medal insertion opening 17 due to its weight. In this way, the medal M is inserted into the medal insertion opening 17 (S92). If the aligned medals M are further pushed toward the end 16*a*, the next medal M is inserted into the medal insertion opening 17. In this way, the plurality of medals are consecutively inserted into the medal insertion opening 17 in the aligned order one by one by continuously pushing the medals M aligned in an upright state in the medal alignment groove 16. As a result, the player can insert many medals M easily and quickly. Since the medal alignment groove 16 is formed so that it slopes downward from the end opposite the end 16*a* (relative to the lengthwise direction of the medal alignment groove 16) toward the end 16*a*, when the medals M are placed in an upright state, the medals M are aligned with their respective positions gradually displaced in the vertical direction. As a result, the contact area between the medals is reduced, thereby reducing friction. Therefore, it is possible to make the medals M easily fall down to the medal insertion opening 17 even if the medals M are pushed toward the end 16*a*.

A medal M inserted into the medal insertion opening 17 is sent via the guide 82 connected to the medal insertion opening 17 to the rail 83, rolls on the rail 83, and is then discharged from the far end of the rail 83 to the medal base 31 (S93).

Also, simultaneously with the above-described respective medal insertion procedures S90 to S93, or independently from the medal insertion procedures, the player can operate the medal insertion portion 12. If the player slides the medal insertion portion 12 on the console panel 10, the medal feeding mechanism 14 connected to the medal insertion portion 12 rotates around the axis of the support shaft 84. In this way, the player can freely change the position of a medal M that falls down to the medal base 31. Incidentally, the movable range of the medal insertion portion 12 is limited by, for example, the shape of the swing-angle limiting hole 18 in the console panel 10. As a result, the swing angle of the medal feeding mechanism 14 is also limited to a specified range.

As described above, simultaneously with continuously inserting medals M aligned in the medal alignment groove 16 into the medal insertion opening 17, the player can change the position of the medal feeding mechanism 14 by operating the medal insertion portion 12. As a result, the medals M can be continuously inserted and supplied to the medal base 31 by changing the medal feed position little by little, which results in increasing the entertainment value of the game. If the player's medal insertion skill increases, he will be able to insert the medals M more strategically, and increase in the repeated rate for the game can be expected.

Next, another embodiment of the present invention will be explained.

FIG. 13 is a perspective view of the main parts of a medal insertion device according to another embodiment that is applied to the pusher game apparatus 100. FIG. 14 is a lengthwise sectional view of the medal insertion portion 12 in FIG. 13. Incidentally, in FIGS. 13 and 14, elements the same as or similar to those in the above-described embodiment are given to the same reference numerals as those used in the above-described embodiment.

In this embodiment, a bend portion 112 is provided on the front side (closer to the player) of the medal payout unit 11 or at its end closer to the medal insertion portion 12 as shown in FIG. 13. The bend portion 112 is connected to, or integrally formed with, the front wall 111, and the bend portion 112 is formed as a flat face or a curved face so that the wall surface of the front wall 111 and the side wall surface 113 of the bend portion 112 closer to the medal payout unit 11 are connected to each other generally smoothly. The top portion 114 of the bend portion 112 is bent in a generally horizontal direction. Also, the top portion 114 is made longer than the movable distance of the medal insertion portion 12 away from the medal payout unit 11 so that at least part of the medal-introducing portion 88 hides under the bend portion 112 no matter which position in the movable range of the medal insertion portion 12 it is located. In other words, the top portion 114 is formed so that it overlaps with at least part of the medal-introducing portion 88 when seen from above. It is favorable to make the end of the medal-introducing portion 88 generally horizontal as shown in FIG. 13.

Because the bend portion 112 is provided as described above, when the player moves the medals M held in the medal payout unit 11 to the medal placement area 19, he can move them by scooping the medals M as if stroking them from the front wall 111 to the bend portion 112, and it is also possible to prevent any problem such as the medals M getting stuck before reaching the medal placement area 19.

FIG. 15 is a perspective external view of the main parts of a pusher game apparatus according to another embodiment of the present invention. This pusher game apparatus is configured in the same manner as the pusher game apparatus 100 shown in FIGS. 1 and 5, except that the pusher game apparatus according to this embodiment has a guide 70 (wall member) instead of the shutter 25; a right tilted plate 24*c* and a left tilted plate 24*d* instead of the plate members 24*a*, 24*b* on both sides of the V-checker 24 at its inlet; and eight U-shaped grooves 22*a* located equally spaced apart around the periphery of the gimmick disk 22. FIG. 16 is a plan view of the gimmick disk 22, the guide 70, and their surrounding area, in the pusher game apparatus, and FIG. 17 is a cross-sectional view of the gimmick disk 22, the guide 70, and their surrounding area as taken along line XVII-XVII in FIG. 16. FIG. 18 is an expanded schematic view of the outside peripheral surface of the guide 70 and the gimmick disk 22 in FIG. 16.

The guide 70 for this pusher game apparatus is a belt-like member located along substantially the lower half of the peripheral wall 22*h* of the gimmick disk 22 with a small gap between the guide 70 and the peripheral wall 22*h*, and the guide 70 is high enough to contact medals M retained in the groove(s) 22*a* in the gimmick disk 22. Incidentally, the guide 70 does not move up or down like the shutter 25, but is fixed. Also, a step groove 71 is formed on the inside wall of the guide. This step groove 71 has a shape of, so to speak, the partly-cutout inside wall of the guide 70. More specifically, the step groove 71 extends along the periphery of the inside wall (extension direction) from the upper left end 73*l* (one end) to the upper right end 73*r* (the other end) as indicated in the drawings.

As shown in the expanded view in FIG. 18, the step groove 71 is formed so that the groove height of the step groove 71 is generally the same as the height of the bottom wall of the groove 22*a* in the gimmick disk 22 in the area from the upper left end 73*l* to an obliquely-left-downward portion 72*l* on the inside wall of the guide 70 (i.e., generally as deep as, or deeper than, the groove 22*a*; although the depth is not particularly limited, about 5 mm), and the groove height of the step groove 71 gradually increases in the area from the obliquely-left-downward portion 72*l* through a central portion 72*c* to an obliquely-right-downward portion 72*r* (i.e., the step depth becomes gradually shallower). In other words, the step groove 71 is composed of a relatively deep flat step extending from the upper left end 73*l* to the obliquely-left-downward portion 72*l* and a slope step extending spirally from the obliquely-left-downward portion 72*l* to the obliquely-right-downward portion 72*r* (i.e., a slope formed on the wall member). Incidentally, the width of the step groove 71 is not particularly limited, but may be, for example, several millimeters.

If there are a normal game and a jackpot game with the pusher game apparatus configured as described above, the pusher game apparatus is configured so that the gimmick disk 22 is rotated clockwise as indicated in the drawing (the direction indicated with arrow Y7 in FIG. 15) in the normal game mode, while the gimmick disk 22 is rotated counterclockwise as indicated in the drawing (the direction indicated with arrow Y5 in FIG. 15) when a jackpot occurs.

If the gimmick disk 22 rotates clockwise in the normal game, the guide 70 serves as a receiver for the gimmick disk 22 rotating with the medals M retained in the groove 22*a*. As a result, in the example illustrated in the drawing, the gimmick disk 22 rotates with two medals M, M piled and retained in each groove 22*a*.

In this case of clockwise rotation, the gimmick disk 22 rotates from the shallower portion (obliquely-right-downward portion 72*r*) of the step groove 71 in the guide 70 toward the deeper portion (obliquely-left-downward portion 72*l*). As a result, the medals held in the grooves 22*a* will not fall over the step groove 71 and out of the gimmick disk 22.

On the other hand, if a jackpot occurs and the gimmick disk 22 rotates counterclockwise, the gimmick disk 22 moves from the deeper portion (obliquely-left-downward portion 72*l*) of the step groove 71 in the guide 70 toward the shallower portion (obliquely-right-downward portion 72*r*) as opposed to the above-described case of the normal game. Therefore, a portion of a medal M resting on the step groove 71 rotates and moves as if to go up to the slope step from around the obliquely-left-downward portion 72*l* of the step groove 71 toward the front of the diagram; and when the medals M have passed somewhere around the central portion 72*c* of the step groove 71, the upper medal M of the two medals M reaches the upper edge of the guide 70 and, therefore, may easily go beyond the guide 70 and fall downward. When the gimmick disk 22 further rotates counterclockwise, the lower medal M also rises in contact with the slope step of the step groove 71, reaches the upper edge of the guide 70 somewhere around the obliquely-right-downward portion 72*r* and, therefore, may easily go beyond the guide 70 and fall downward. When the gimmick disk 22 further rotates counterclockwise as described above, most of the medals M, M retained in the grooves 22*a* go beyond the guide 70, fall down to the right tilted plate 24*c* without winning the prize for the V-checker 24, pass through the payout opening 26 (see FIG. 3), and are supplied to the medal base 31.

Therefore, in the case of, for example, the normal game played with the pusher game apparatus configured as described above, the grooves 22*a* are filled with medals M because of the existence of the guide 70 and other medals M go beyond the guide 70 and fall downward. As a result, it is possible to increase the V-checker 24 prize winning rate and enhance the amusement value (such as the entertainment value and game-feel) of the game. Furthermore, the pusher game apparatus can be controlled so that if a jackpot which is different from the normal game occurs, the medals M held in the grooves 22*a* in the gimmick disk 22 can be made to fall off from the gimmick disk 22 and even avoid the V-checker 24 bonus simply by controlling the rotational direction of the gimmick disk 22.

Since the step groove 71 extends to the edge of the upper left end 73*l* on the inside wall of the guide 70, even if medals M rise up in the groove 22*a* when the gimmick disk 22 is rotating clockwise, it is possible to prevent the medals M from being caught in the gap between the inside wall of the guide 70 and the peripheral wall 22*h* of the gimmick disk 22 and thereby further enhance reliability of the apparatus. Furthermore, it is favorable to have the step groove 71 inclined radially downward toward the inside of the gimmick disk 22. If the step groove 71 is inclined radially downward, even when the gimmick disk 22 is rotating counterclockwise and the medals M move along the step groove 71, it is possible to prevent the medals M from tilting or rising up inconveniently and sufficiently prevent the medals M from being caught in the gap between the inside wall of the guide 70 and the peripheral wall 22*h* of the gimmick disk 22.

Other operations and effects of this pusher game apparatus are similar to those of the pusher game apparatus 100. Accordingly, an explanation about the other operations and effects has been omitted in order to avoid redundancy.

Incidentally, the present invention is not limited to the embodiments described above, and various modifications may be made to the embodiments without changing the gist of the invention.

For example, the aforementioned embodiments have described that the bend portion 82*a* at the upper end of the guide 82 and the lower portion of the medal insertion portion 12 are fastened to each other with screw to connect them together so that the medals inserted into the medal insertion portion 12 can be delivered to the medal feeding mechanism 14. However, this is merely an example, and any means may be employed as long as the medal insertion portion 12 and the medal feeding mechanism 14 are connected to each other so that the medals inserted into the medal insertion portion 12 can be delivered to the medal feeding mechanism 14.

In the aforementioned embodiments, how the claw 86 of the medal insertion portion 12 should be attached to the anti-lift plate 87 is not particularly specified. However, any attachment means may be employed as long as the claw 86 and the anti-lift plate 87 are configured so that the claw 86 will not fall out of the swing-angle limiting hole 18; or the claw 86 and the anti-lift plate 87 may be formed integrally (for example, the end of the claw 86 may be formed into a hook shape).

Furthermore, the aforementioned embodiments have described the configuration in which the swing angle of the medal feeding mechanism 14 is limited by the claw 86 and the swing-angle limiting hole 18; however, other means may be adopted. For example, a stopper structure for limiting the movement (such as the swing angle) of the medal feeding mechanism 14 may be provided on the medal feeding mechanism 14, so that the movement (such as the swing angle) is limited by contact with the console panel 10.

Also, the aforementioned embodiments have described the configuration in which the medal feeding mechanism 14 can rotate around the support shaft 84 and the top of the medal feeding mechanism 14 is movable as if tracing an arc. However, the medal feeding mechanism 14 may be configured so that it can move back and forth (in a direction from the front side to the back side of the apparatus). Alternatively, the medal feeding mechanism 14 may be configured so that the movable range of the medal insertion portion 12 is limited to a specified range and the top of the medal feeding mechanism 14 can be moved within a specified range in association of the specified movable range of the medal insertion portion 12. The medal insertion portion according to the aforementioned embodiments may be used not only for the pusher game apparatus, but also for game apparatuses for executing various video games such as a roulette game, a shooting game, and an action game, in which a medal inserted into the medal insertion opening is detected, such detection causes a switch input and game images generated by the video game control unit are displayed on the display 23.

The shape of the gimmick disk 22 is not limited to a flat disk, and may be, for example, a polygonal rotary board as long as it is shaped and configured so that it has grooves capable of retaining medals M and can make the medals M fall downward. The rotational direction and the rotational speed do not have to be always constant. Furthermore, the top surface of the gimmick disk 22 may be either flat or not flat; for example, the central portion of the gimmick disk 22 may be raised (may be thicker and bulge out) higher than the peripheral portion of the gimmick disk 22, or may be recessed.

Also, the shape and quantity of the grooves 22*a* and the checkers or similar such as the V-checker 24 and the checkers 32 are not limited to those illustrated in the drawings. Moreover, the depth Dg of the groove 22*a* may not always be twice the thickness of a medal M, and may be equal to or three or more times the thickness of a medal M, or may even not necessary be equal to the integral multiple of the thickness of a medal M. Also, the groove 22*a* may or may not have the chamfer 22*t*, and the surface of the chamfer 22*t* may have a curvature; the chamfer 22*t* may be provided at part of the side wall of the groove 22*a*; and the taper angle is not limited. The shape of the protruding member of the medal guide 22*b* is not limited to the shape illustrated in the drawings, and may be, for example, a simple plate-like protrusion or a protrusion with pins set thereon. The planar view shape of the protruding member may not have to be a semicircular shape, and may be any of various other shapes such as circular, oval, rectangular, and polygonal shapes. Also, the protruding member does not have to extend along a diameter of the gimmick disk 22.

Furthermore, there may be no medal guide 22*b*. In addition, the shutter 25 may not have to be made of a single plate and, for example, the shutter 25 may have a slit whose width is shorter than the outside diameter $D_M$ of a medal M. Also, the shutter 25 may be formed so that, for example, its central portion is higher than both ends; and the shutter 25 may be moved so that when the shutter 25 is raised, its upper edge slightly protrudes from the top surface 22*m* of the gimmick disk 22.

The number of stations 1 is not required to be more than one, and one station 1 may be sufficient. Another pusher game apparatus 100 may also be installed, and it is favorable to have the arithmetic control units 65 for their respective common processing units 6 (host) connected to each other to enable communication between them. Moreover, the interference unit on the medal base 31, which interferes with the medals M, may be composed of a separate structure, not the lower-end front wall 27 of the V-zone game unit 2. Furthermore, the gimmick disk 22 may be designed to constantly turn, not always turn, or stop turning at appropriate times. For example, the gimmick disk 22 may be made to turn only when it is used.

INDUSTRIAL APPLICABILITY

With the pusher game apparatus according to the present invention as described above, the player can gain more medals than he expects, thereby enhancing the entertainment value and game-feel. The pusher game apparatus according to the invention can be widely used as a pusher game apparatus for arcade games or as home-use games or similar that simulate, through visual images, the pusher game apparatus.

Figure 1:
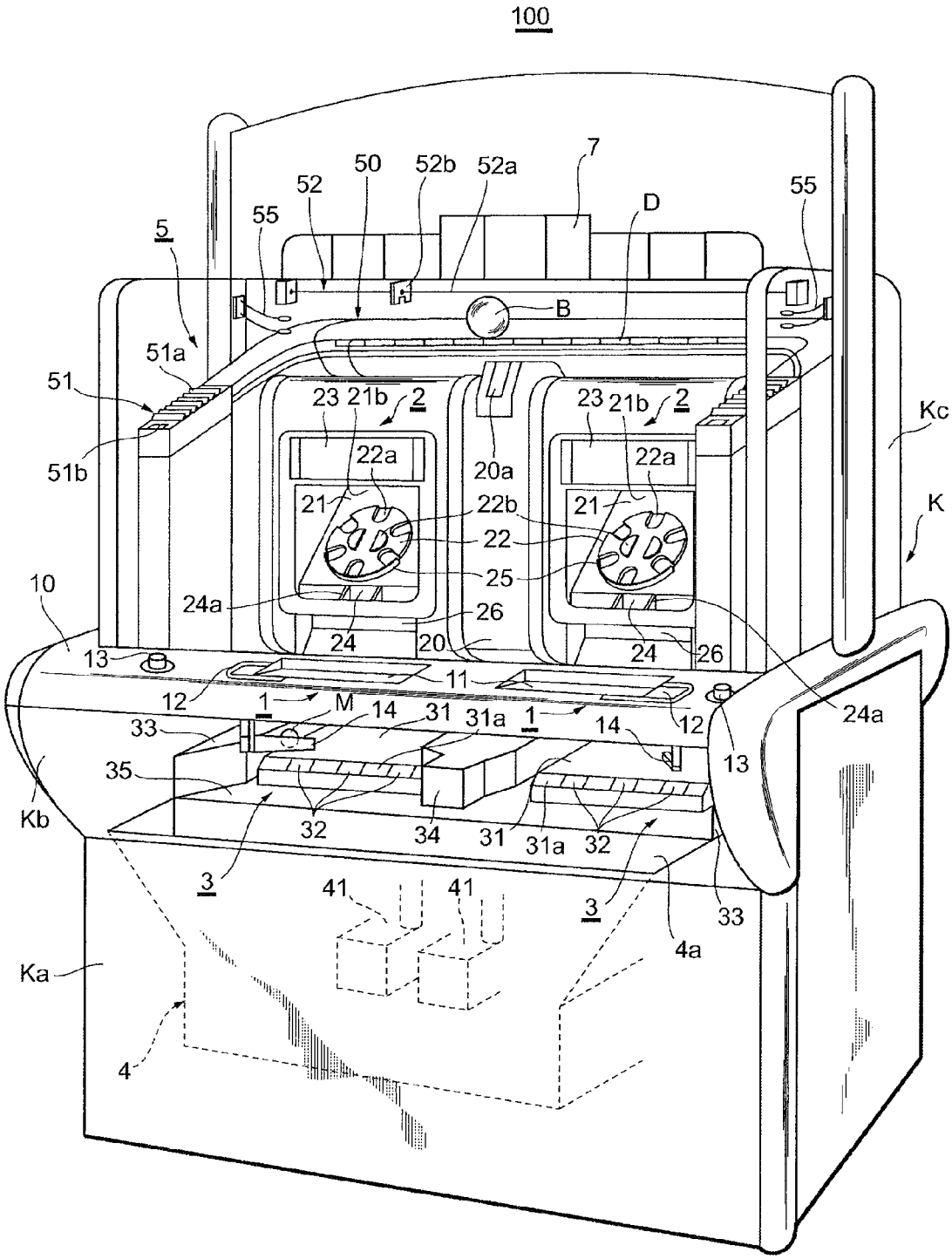
FIG. 1 is a perspective external view of a pusher game apparatus according to the present invention.
Figure 2:
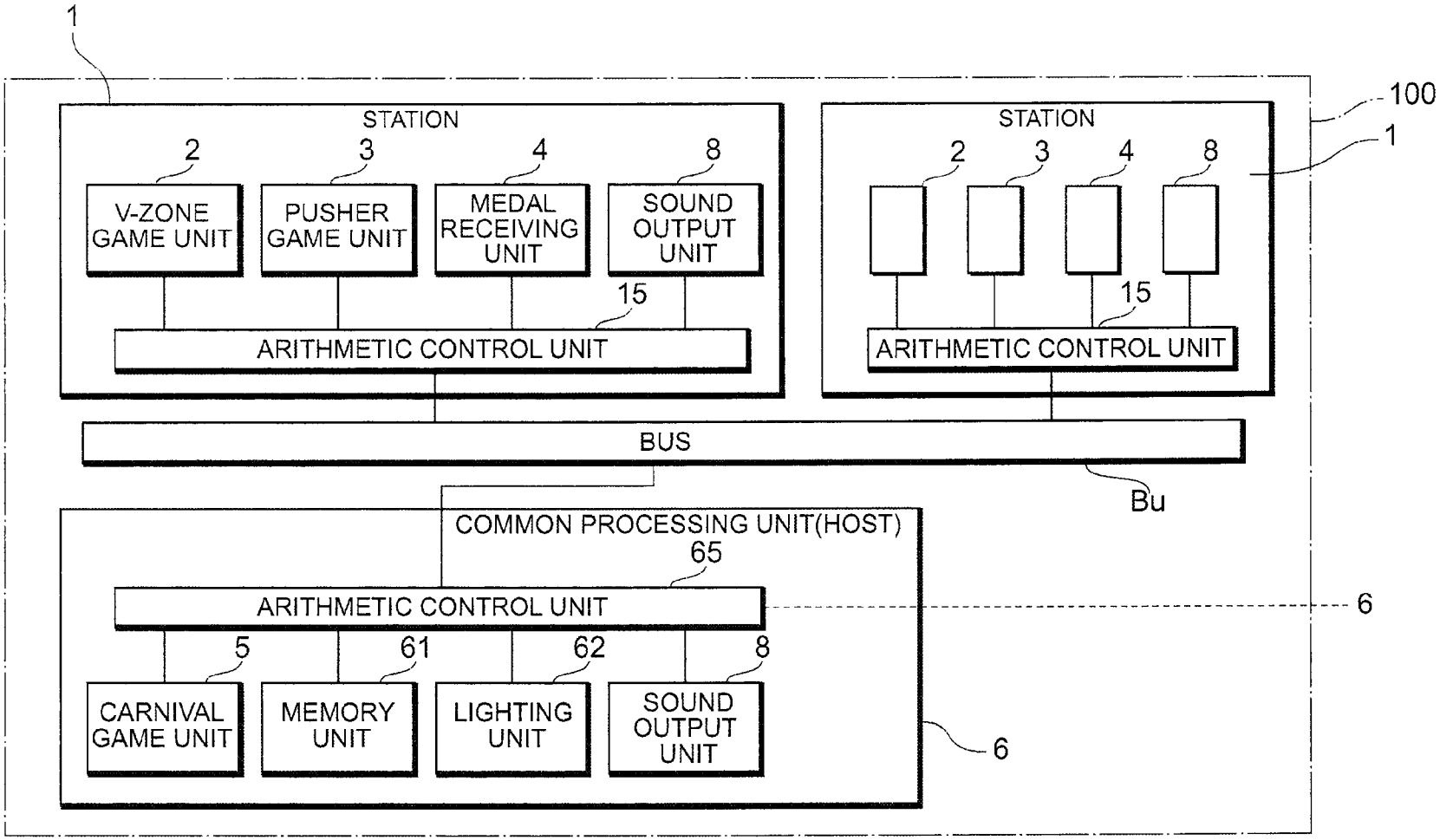
FIG. 2 is a schematic block diagram showing the functional configuration of a pusher game apparatus 100.
Figure 3:
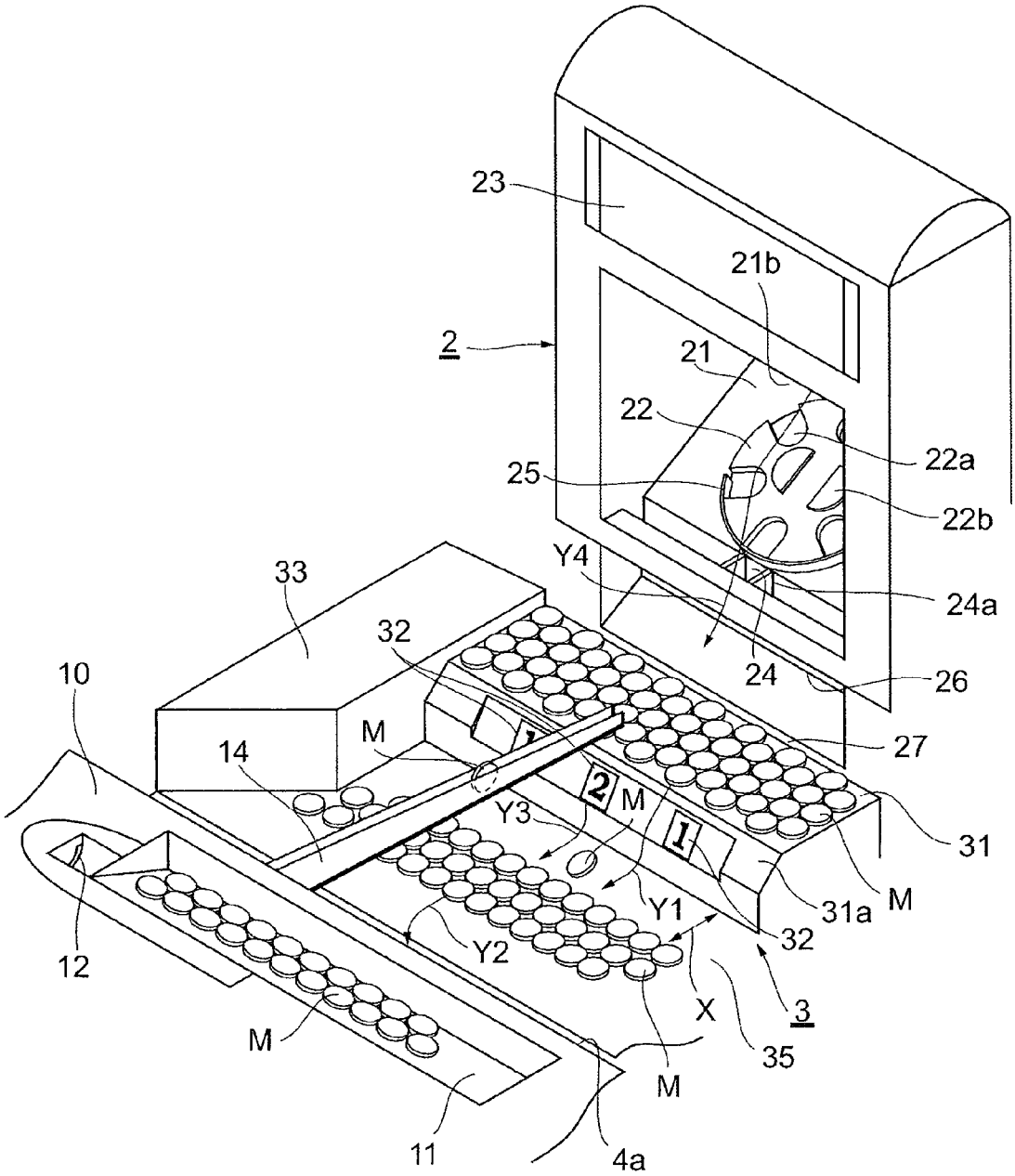
FIG. 3 is a perspective view of the main parts of the pusher game apparatus 100.
Figure 4:
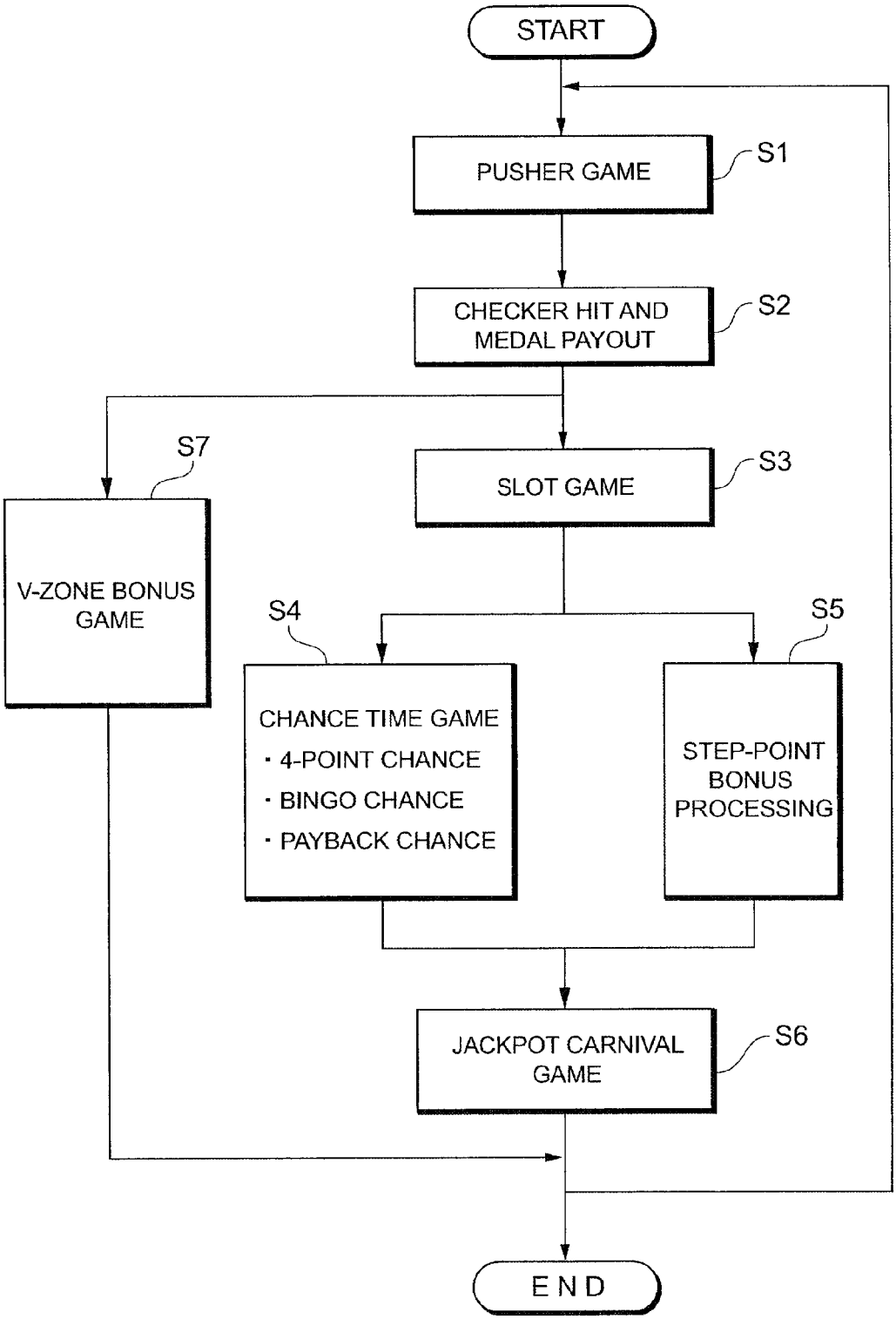
FIG. 4 is a flowchart illustrating an example of the procedure for executing a medal game with the pusher game apparatus 100.
Figure 5:
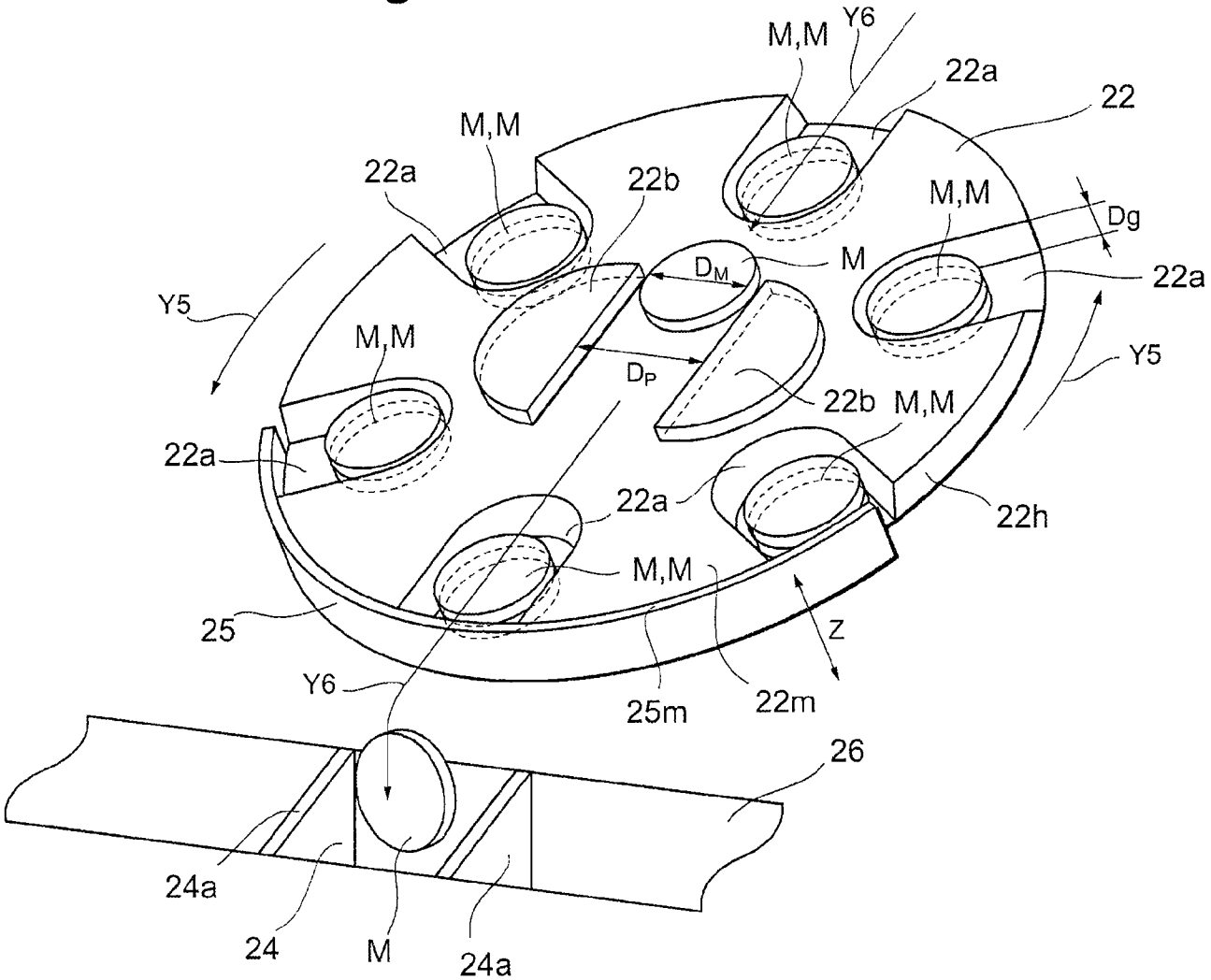
FIG. 5 is a perspective view of a gimmick disk 22 and the main parts around it.
Figure 6:
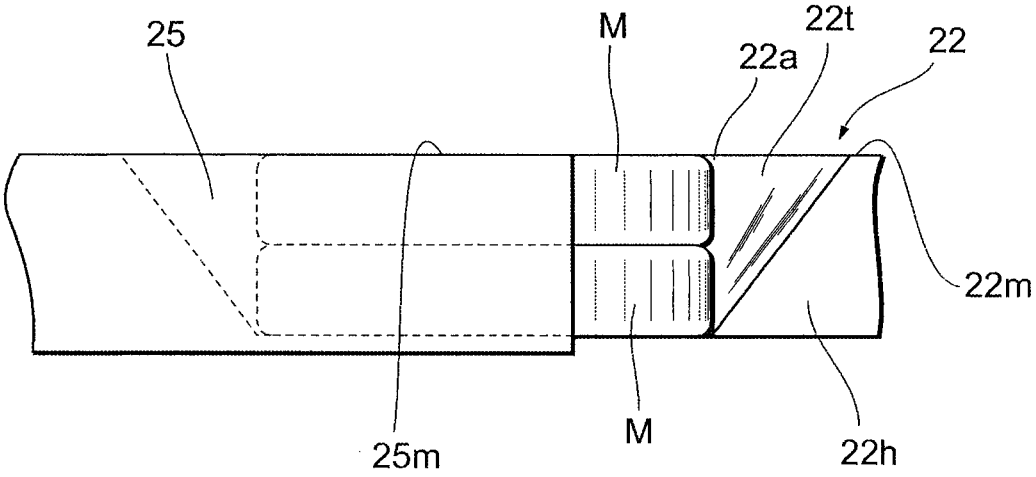
FIG. 6 is a side view of part of the gimmick disk 22 where a groove 22*a* is formed.
Figure 7:
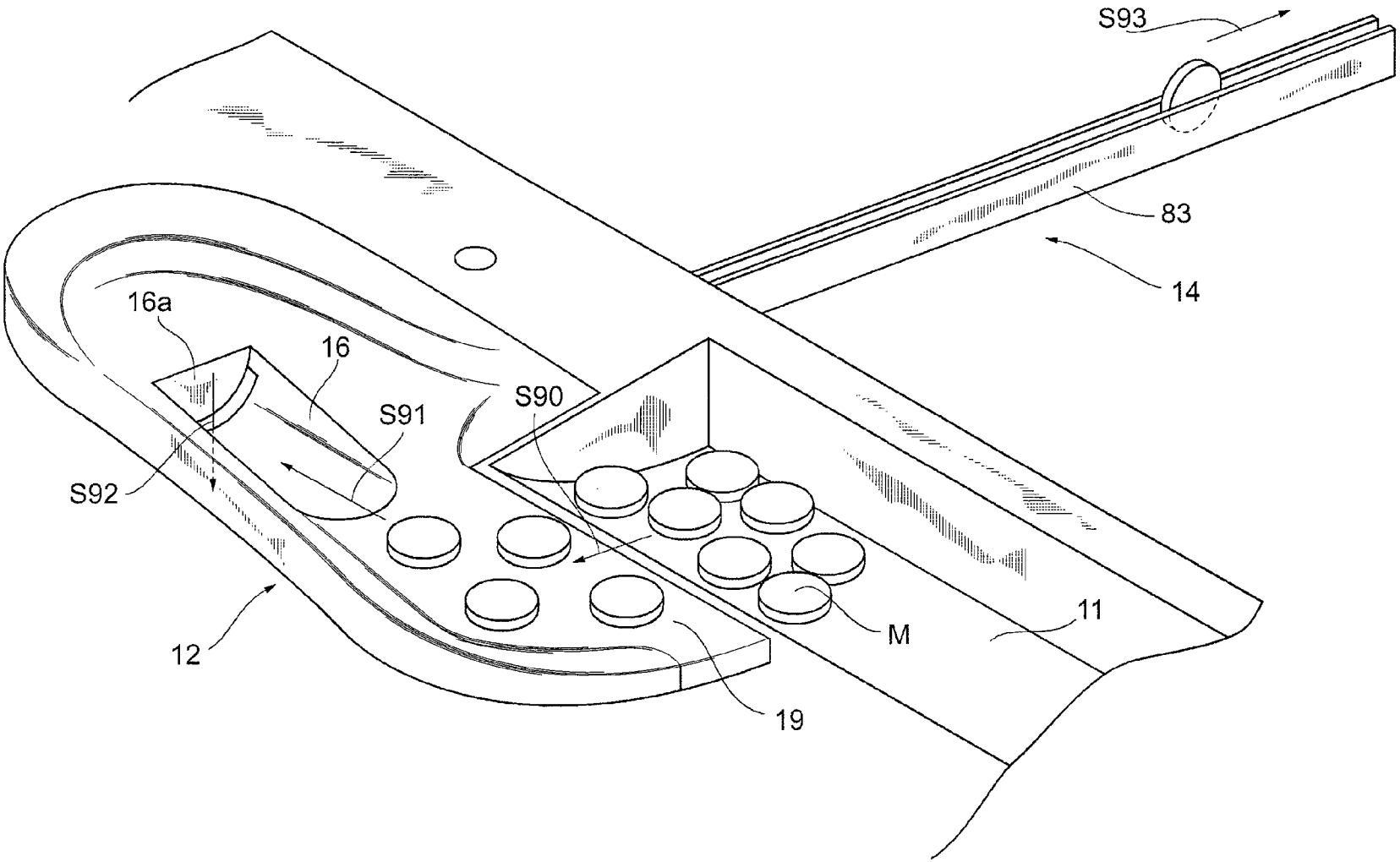
FIG. 7 is a perspective view of the main parts of a medal insertion device.
Figure 8:
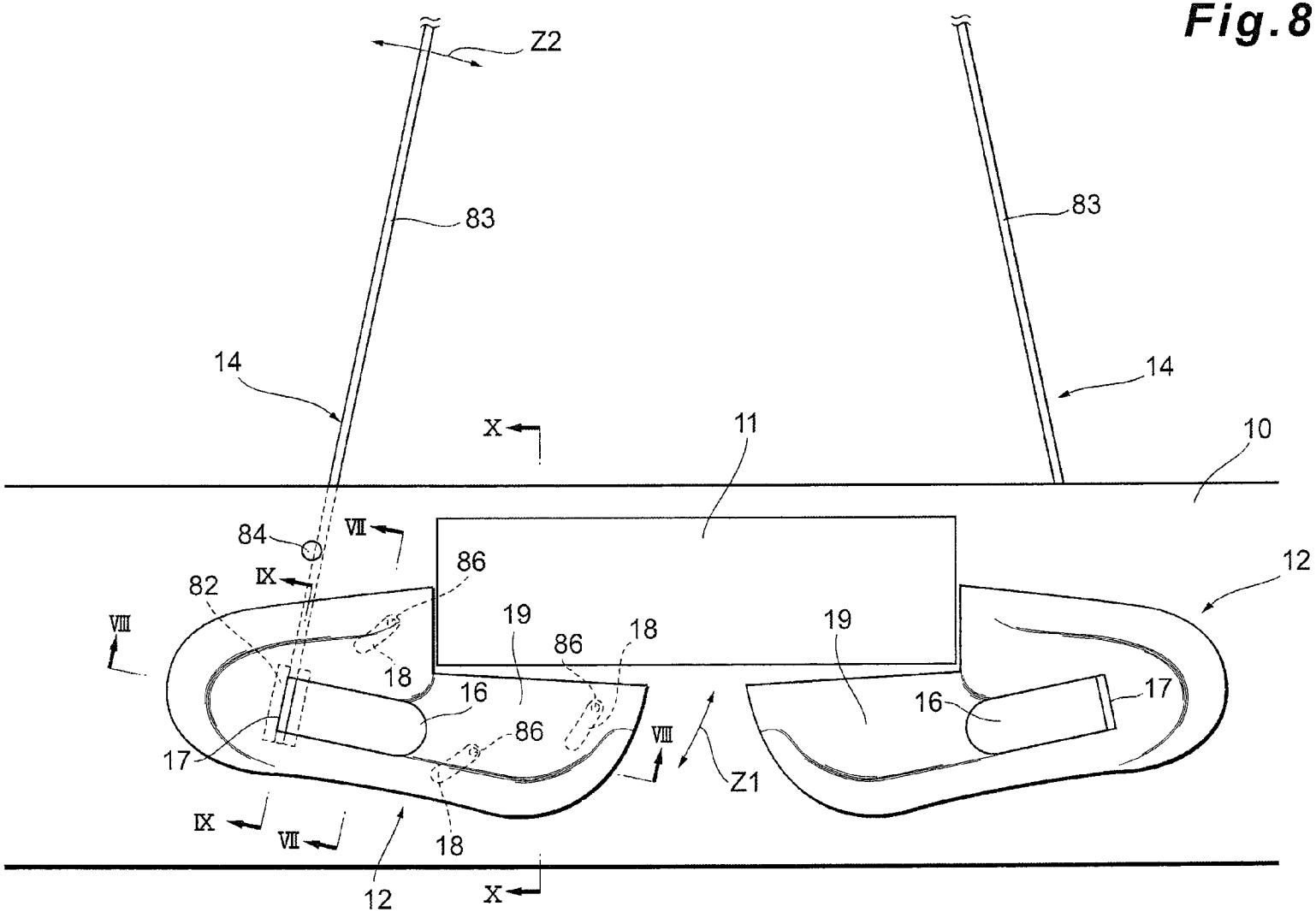
FIG. 8 is a plan view of the main parts of the medal insertion device.
Figure 9:
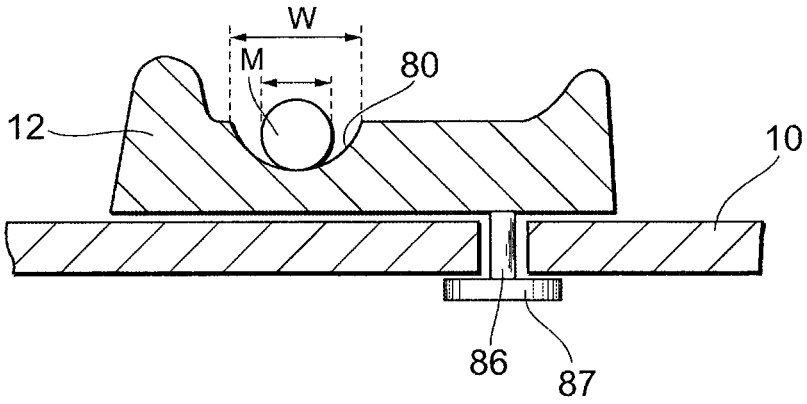
FIG. 9 is a cross-sectional view of the main parts of the medal insertion device as taken along line VII-VII in FIG. 8.
Figure 10:
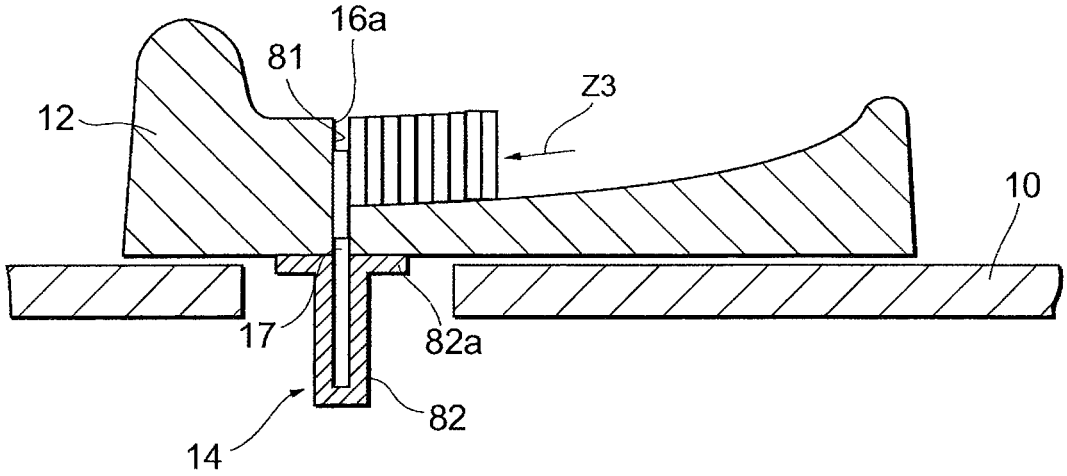
FIG. 10 is a cross-sectional view of the main parts of the medal insertion device as taken along line VIII-VIII in FIG. 8.
Figure 11:
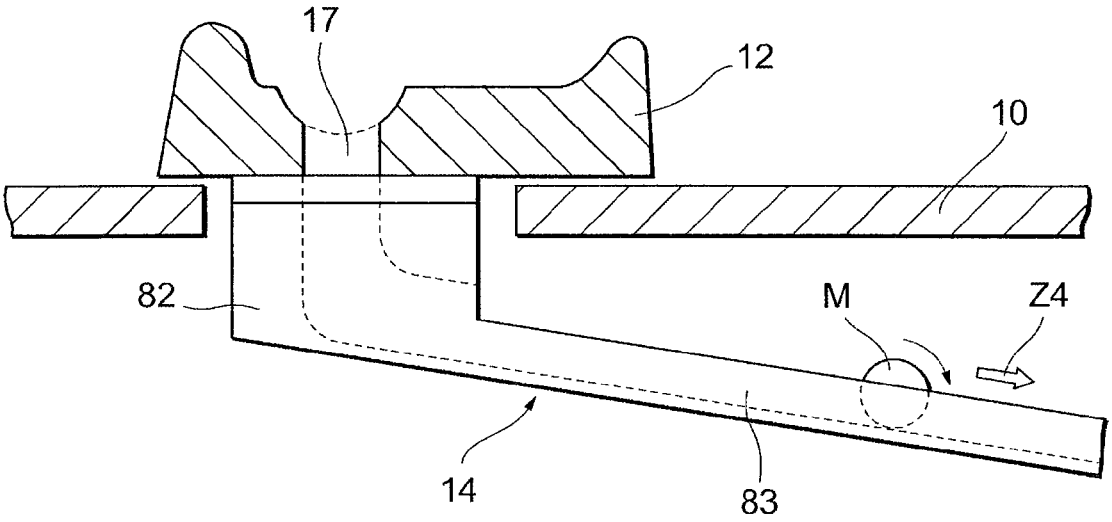
FIG. 11 is a cross-sectional view of the main parts of the medal insertion device as taken along line IX-IX in FIG. 8.
Figure 12:
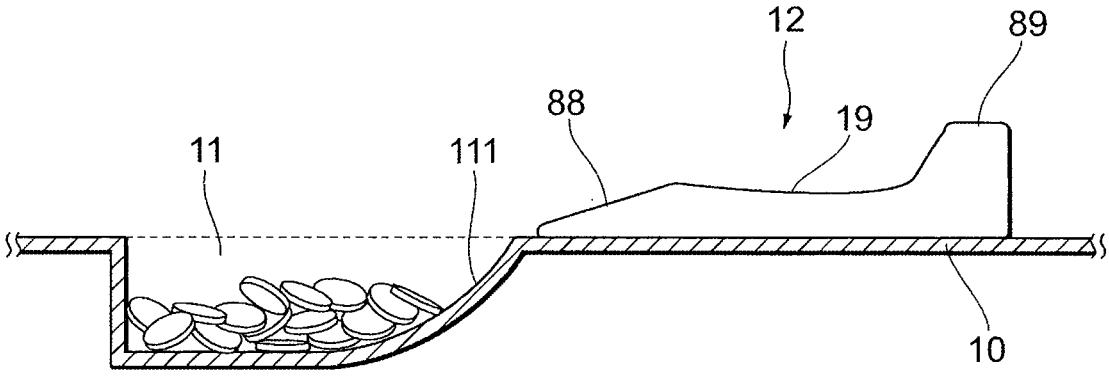
FIG. 12 is a cross-sectional view of the main parts of the medal insertion device as taken along line X-X in FIG. 8.
Figure 13:
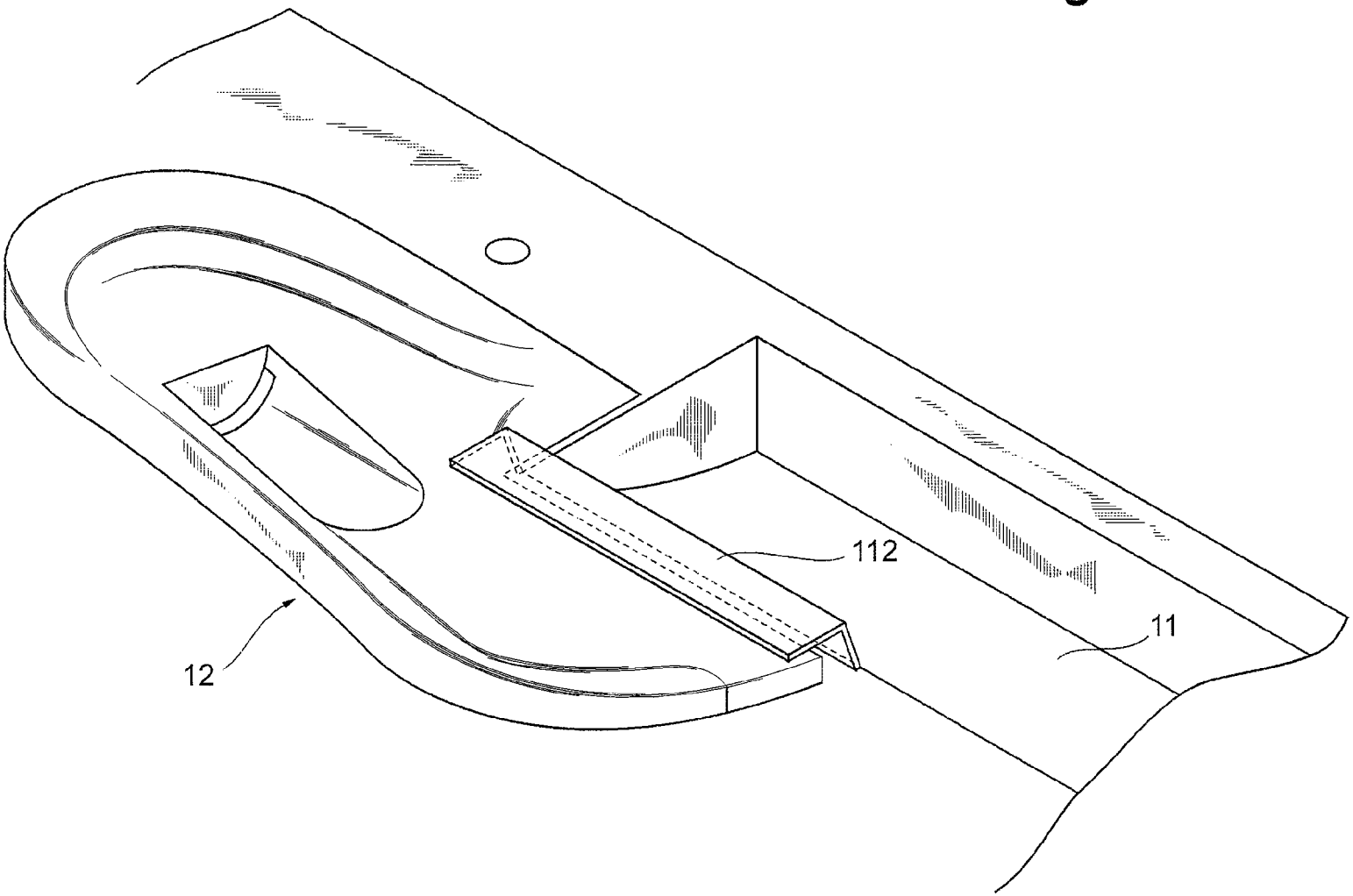
FIG. 13 is a perspective view of the main parts of a medal insertion device according to another embodiment.
Figure 14:
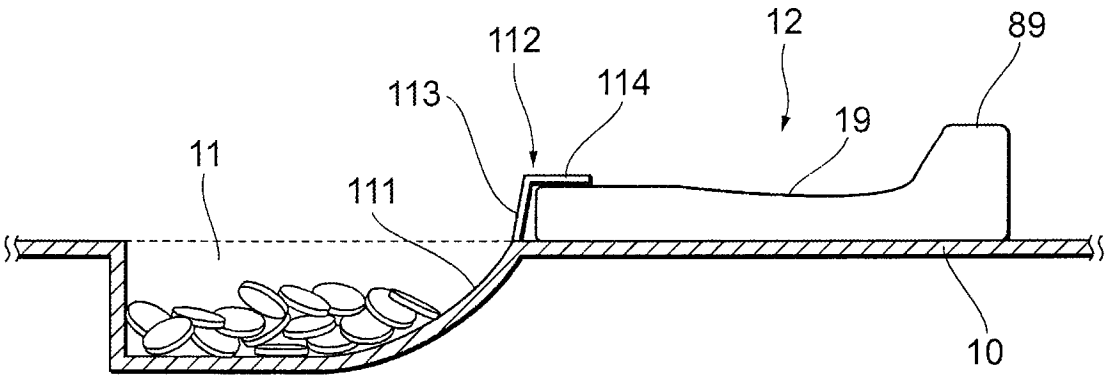
FIG. 14 is a lengthwise sectional view of the medal insertion portion 12 in FIG. 13.
Figure 15:
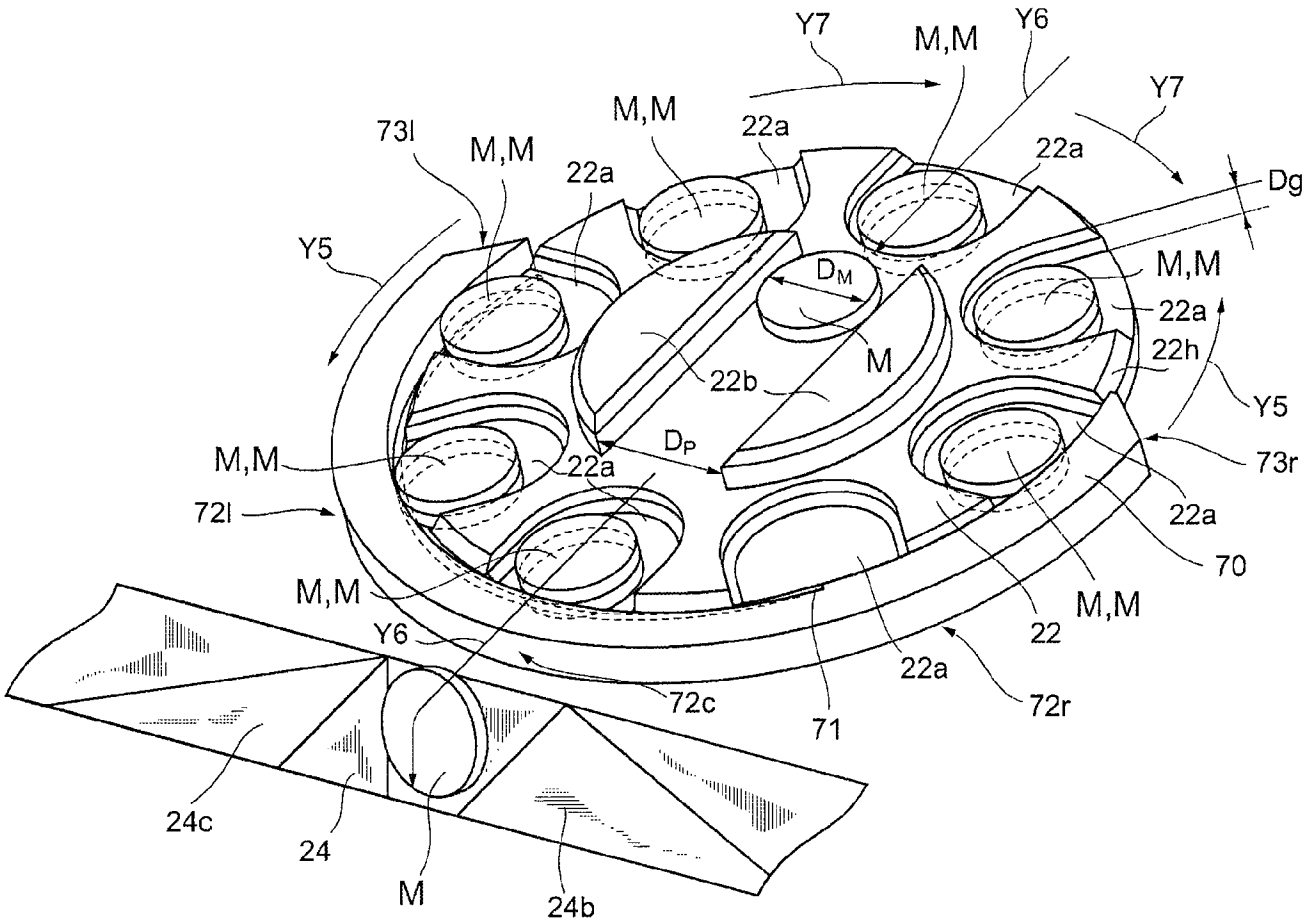
FIG. 15 is a perspective external view of the main parts of a pusher game apparatus according to another embodiment of the present invention.
Figure 16:
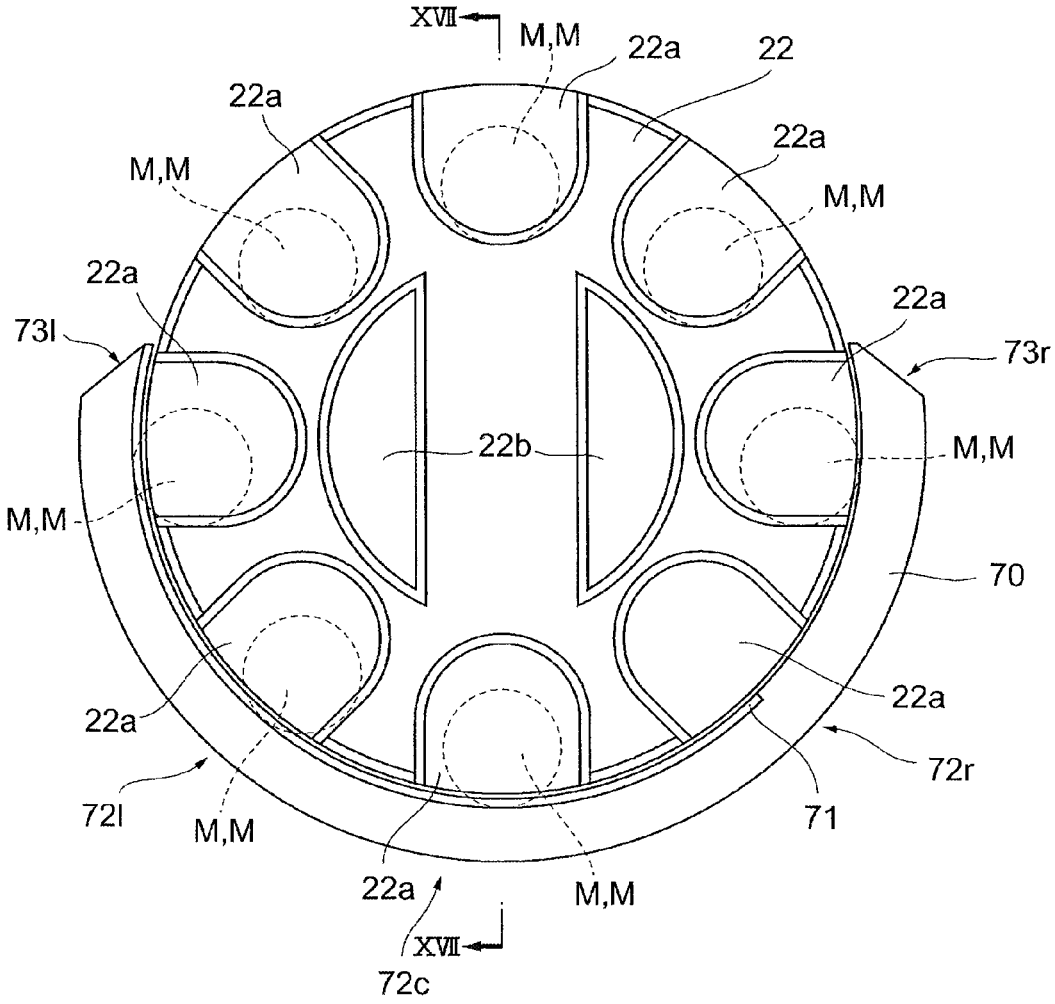
FIG. 16 is a plan view of a gimmick disk 22, a guide 70, and their surrounding area, in the pusher game apparatus in FIG. 15.
Figure 17:
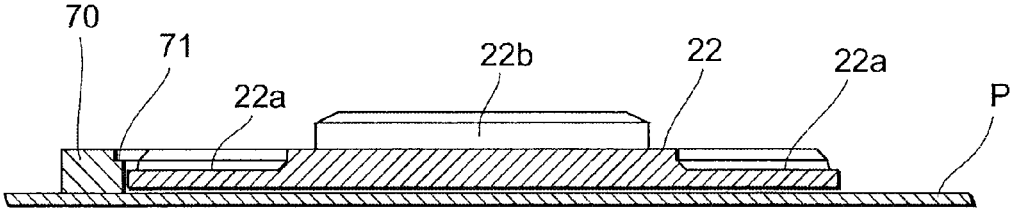
FIG. 17 is a cross-sectional view of the gimmick disk 22, the guide 70, and their surrounding area, in the pusher game apparatus as taken along line XVII-XVII in FIG. 15.
Figure 18:
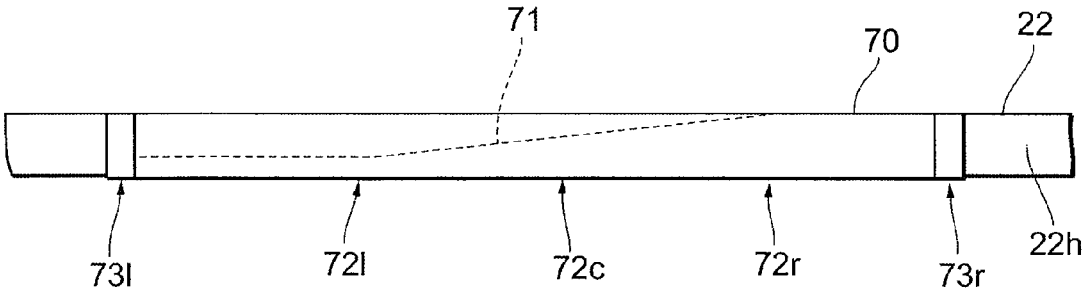
FIG. 18 is an expanded schematic view of the outside peripheral surface of the guide 70 and the gimmick disk 22 in FIG. 15.

What is claimed is:

1. A medal game apparatus comprising:

a lower base configured to receive a plurality of medals thereon;

an upper base configured to receive the plurality of medals thereon, the upper base being seated on a rear portion of the lower base and configured to be movable relative to the lower base in a direction to a front portion of the lower base;

a medal acceptance portion configured to accept at least one medal inserted therein and to be movable;

a medal feeding mechanism extending in a direction toward the upper base and connected to the medal acceptance portion;

an interference portion located at one end of the upper base and configured to interfere with ones of the plurality of medals placed on the upper base;

a medal storing unit located under the lower base and configured to store ones of the plurality of medals which fall down from the lower base; and a medal dispenser unit configured to dispense the ones of the plurality of medals stored in the medal storing unit, wherein the medal acceptance portion comprises:

a medal placement area located adjacent to the medal dispenser unit and configured to receive the plurality of medals lying down, a medal alignment recess continuously connected to the medal placement area, a portion of the medal alignment recess having a curved surface substantially along a periphery of a medal, and a medal insertion slot located at an opposite end of the medal alignment recess to the medal placement area, wherein the medal feeding mechanism comprises:

a guide connected to the medal insertion slot, and a rail connected to the guide, and wherein the guide is configured to guide a medal inserted into the medal insertion slot to the rail, and the rail is configured to feed the medal to the upper base.

2. The medal game apparatus according to claim 1, further comprising a support shaft configured to pivotally support the medal insertion slot so that the medal insertion slot can be freely rotated.

3. The medal game apparatus according to claim 1, further comprising a stopper configured to limit a movable area of the medal insertion slot to a specified area.

4. The medal game apparatus according to claim 1, wherein the medal insertion slot is inclined so that an end periphery closer to the medal dispenser unit is thinner than an inside part of the medal insertion slot, and a thickness of the medal insertion slot increases toward the inside part of the medal insertion slot.

5. The medal game apparatus according to claim 1, further comprising a bend portion protruding from a front periphery of the medal dispenser unit to cover at least part of an end periphery of the medal insertion slot.

* * * * *